US012685415B2

(12) United States Patent
Ohm et al.

(10) Patent No.: US 12,685,415 B2
(45) Date of Patent: Jul. 21, 2026

(54) MOBILE CLEANING ROBOT SUSPENSION

(71) Applicant: iRobot Corporation, Bedford, MA (US)

(72) Inventors: Timothy R. Ohm, Grover Beach, CA (US); Erik Amaral, Bolton, MA (US)

(73) Assignee: iRobot Corporation, Bedford, MA (US)

( * ) Notice: Subject to any disclaimer, the term of this patent is extended or adjusted under 35 U.S.C. 154(b) by 325 days.

(21) Appl. No.: 18/369,665

(22) Filed: Sep. 18, 2023

(65) Prior Publication Data

US 2025/0089958 A1 Mar. 20, 2025

(51) Int. Cl.

| | |
|---|---|
| ***A47L 9/00*** | (2006.01) |
| ***A47L 11/28*** | (2006.01) |
| ***A47L 11/40*** | (2006.01) |

(52) U.S. Cl.

CPC ..... *A47L 9/009* (2013.01); *A47L 11/28* (2013.01); *A47L 11/4066* (2013.01); *A47L 11/4072* (2013.01); *A47L 2201/00* (2013.01)

(58) Field of Classification Search

CPC ..... A47L 9/009; A47L 11/28; A47L 11/4066; A47L 11/4072; A47L 2201/00

See application file for complete search history.

(56) References Cited

U.S. PATENT DOCUMENTS

| | | | | |
|---|---|---|---|---|
| 2016/0015232 | A1 | 1/2016 | Nakamura et al. | |
| 2019/0290089 | A1 * | 9/2019 | Johnson | A47L 11/4013 |
| 2019/0357743 | A1 | 11/2019 | Koura et al. | |
| 2023/0270299 | A1 | 8/2023 | Ohm et al. | |

OTHER PUBLICATIONS

"International Application Serial No. PCT US2024 046856, International Search Report mailed Dec. 5, 2024", 3 pgs.
"International Application Serial No. PCT US2024 046856, Written Opinion mailed Dec. 5, 2024", 5 pgs.

* cited by examiner

*Primary Examiner* — Andrew A Horton
(74) *Attorney, Agent, or Firm* — Maschoff Brennan

(57) ABSTRACT

A mobile cleaning robot can be movable within an environment, the mobile cleaning robot can include a body and a drive arm movable with respect to the body between an extended position and a retracted position. The robot can include a drive wheel connected to the drive arm and movable therewith. The drive wheel can be operable to move the mobile cleaning robot. The robot can include a first link connected to the body and connected to the drive arm. The robot can include a second link connected to the body and connected to the drive arm to, together with the first link, the body, and the drive arm, define a center of rotation about which the drive arm and the drive wheel rotate between the extended position and the retracted position.

20 Claims, 14 Drawing Sheets

MOBILE CLEANING ROBOT SUSPENSION

BACKGROUND

Mobile robots include mobile cleaning robots that can perform cleaning tasks within an environment, such as a home. A mobile cleaning robot can navigate across a floor surface and avoid obstacles while vacuuming the floor surface and operating rotatable members carried by the robot to ingest debris from the floor surface. As the robot moves across the floor surface, the robot can rotate the rotatable members, which can engage the debris and guide the debris toward a vacuum airflow generated by the robot. The rotatable members and the vacuum airflow can thereby cooperate to allow the robot to ingest debris.

SUMMARY

Mobile cleaning robots can autonomously navigate through environments to perform cleaning operations, often traversing over, and navigating around, obstacles. Mobile cleaning robots include suspension systems to provide sufficient wheel downforce to overcome obstacles and to provide effective cleaning on various surfaces. Because obstacles can vary in shape and size and because floor types can also vary, a required wheel downforce can vary during operation of the robot. Many robots include a front-pivoting suspension system, which can effectively deliver downforce; however, the delivered downforce can differ at different heights of the drive wheel relative to the body and the downforce can differ between moving in a forward direction and a rearward direction.

This disclosure describes devices and methods that can help to address this problem such as by including a suspension system including a linkage that can provide a virtual center of rotation of the wheel assembly at a point near (or below) a bottom portion of the drive wheel throughout the range of travel of the drive wheel with respect to the robot body, allowing a delivered downforce to remain relatively constant throughout the range of travel and also between forward movement and rearward movement of the robot, helping to increase traction of the drive wheel(s) and reduce drag on the mobile cleaning robot.

For example, a mobile cleaning robot can be movable within an environment, the mobile cleaning robot can include a body and a drive arm movable with respect to the body between an extended position and a retracted position. The robot can include a drive wheel connected to the drive arm and movable therewith. The drive wheel can be operable to move the mobile cleaning robot. The robot can include a first link connected to the body and connected to the drive arm. The robot can include a second link connected to the body and connected to the drive arm to, together with the first link, the body, and the drive arm, define a center of rotation about which the drive arm and the drive wheel rotate between the extended position and the retracted position.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Robot Operation Summary

Figure 1:
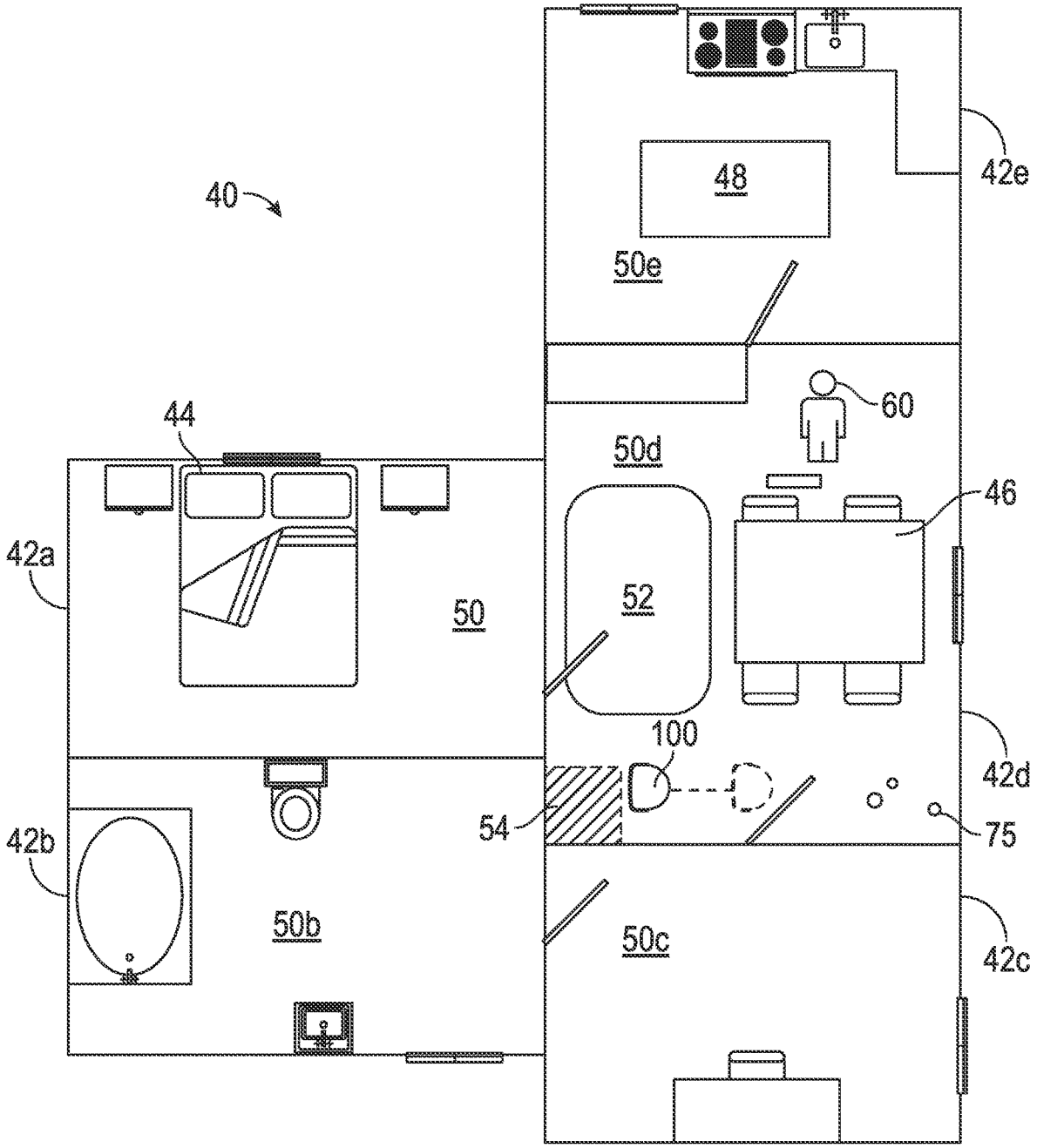
FIG. 1 illustrates a plan view of a mobile cleaning robot in an environment.

FIG. 1 illustrates a plan view of a mobile cleaning robot 100 in an environment 40, in accordance with at least one example of this disclosure. The environment 40 can be a dwelling, such as a home or an apartment, and can include rooms 42*a*-42*e*. Obstacles, such as a bed 44, a table 46, and an island 48 can be located in the rooms 42 of the environment. Each of the rooms 42*a*-42*e* can have a floor surface 50*a*-50*e*, respectively. Some rooms, such as the room 42*d*, can include a rug, such as a rug 52. The floor surfaces 50 can be of one or more types such as hardwood, ceramic, low-pile carpet, medium-pile carpet, long (or high)-pile carpet, stone, or the like.

The mobile cleaning robot 100 can be operated, such as by a user 60, to autonomously clean the environment 40 in a room-by-room fashion. In some examples, the robot 100 can clean the floor surface 50*a* of one room, such as the room 42*a*, before moving to the next room, such as the room 42*d*, to clean the surface of the room 42*d*. Different rooms can have different types of floor surfaces. For example, the room 42*e* (which can be a kitchen) can have a hard floor surface, such as wood or ceramic tile, and the room 42*a* (which can be a bedroom) can have a carpet surface, such as a medium pile carpet. Other rooms, such as the room 42*d* (which can be a dining room) can include multiple surfaces where the rug 52 is located within the room 42*d*.

During cleaning or traveling operations, the robot 100 can use data collected from various sensors (such as optical sensors) and calculations (such as odometry and obstacle detection) to develop a map of the environment 40. Once the map is created, the user 60 can define rooms or zones (such as the rooms 42) within the map. The map can be presentable to the user 60 on a user interface, such as a mobile device, where the user 60 can direct or change cleaning preferences, for example.

Also, during operation, the robot 100 can detect surface types within each of the rooms 42, which can be stored in the robot 100 or another device. The robot 100 can update the map (or data related thereto) such as to include or account for surface types of the floor surfaces 50*a*-50*e* of each of the respective rooms 42 of the environment 40. In some examples, the map can be updated to show the different surface types such as within each of the rooms 42.

In some examples, the user 60 can define a behavior control zone 54. In autonomous operation, the robot 100 can initiate a behavior in response to being in or near the behavior control zone 54. For example, the user 60 can define an area of the environment 40 that is prone to becoming dirty to be the behavior control zone 54. In response, the robot 100 can initiate a focused cleaning behavior in which the robot 100 performs a focused cleaning of a portion of the floor surface 50*d* in the behavior control zone 54.

Robot Example

Figure 2A:
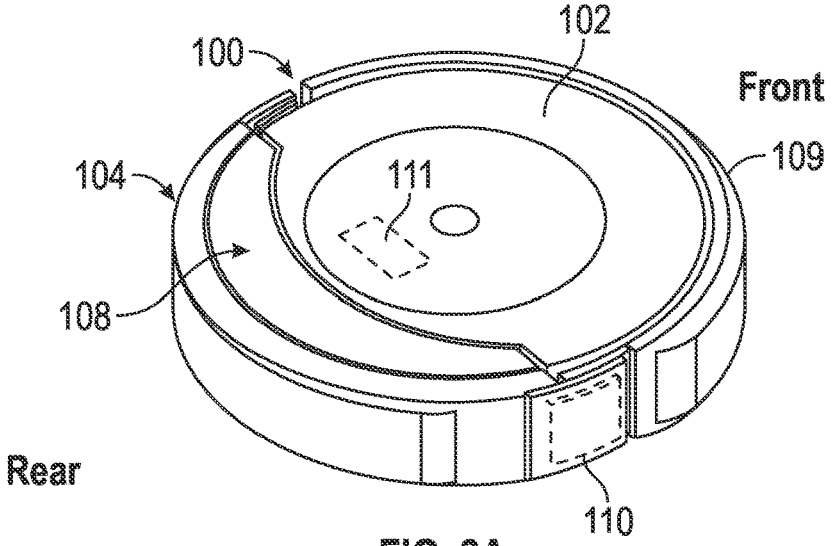
FIG. 2A illustrates an isometric view of a mobile cleaning robot in a first condition.
Figure 2B:
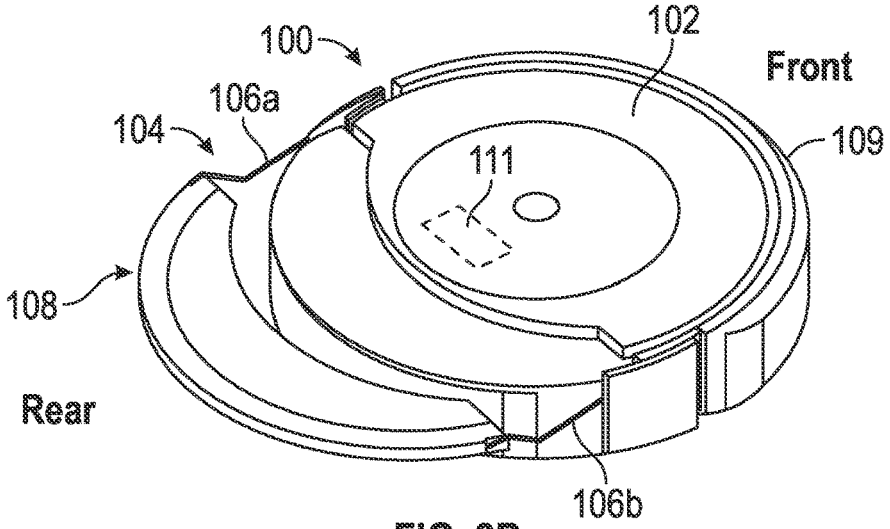
FIG. 2B illustrates an isometric view of a mobile cleaning robot in a second condition.
Figure 2C:
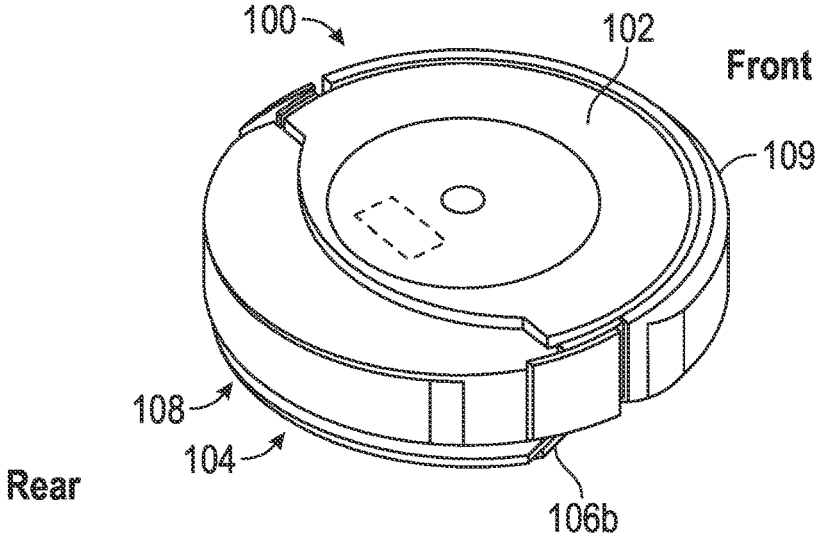
FIG. 2C illustrates an isometric view of a mobile cleaning robot in a third condition.

FIG. 2A illustrates an isometric view of a mobile cleaning robot 100 with a pad assembly in a stored position. FIG. 2B illustrates an isometric view of the mobile cleaning robot 100 with the pad assembly in an extended position. FIG. 2C illustrates an isometric view of the mobile cleaning robot 100 with the pad assembly in a mopping position. FIGS. 2A-2C also show orientation indicators Front and Rear. FIGS. 2A-2C are discussed together below.

The mobile cleaning robot 100 can include a body 102 and a mopping system 104. The mopping system 104 can include arms 106*a* and 106*b* (referred to together as arms 106) and a pad assembly 108. The robot 100 can also include a bumper 109 and other features such as an extractor (including rollers), one or more side brushes, a vacuum system, a controller, a drive system (e.g., motor, geartrain, and wheels), a caster, and sensors, as discussed in further detail below. A distal portion of the arms 106 can be connected to the pad assembly 108 and a proximal portion of the arms 106*a* and 106*b* can be connected to an internal drive system to drive the arms 106 to move the pad assembly 108.

Figure 2D:
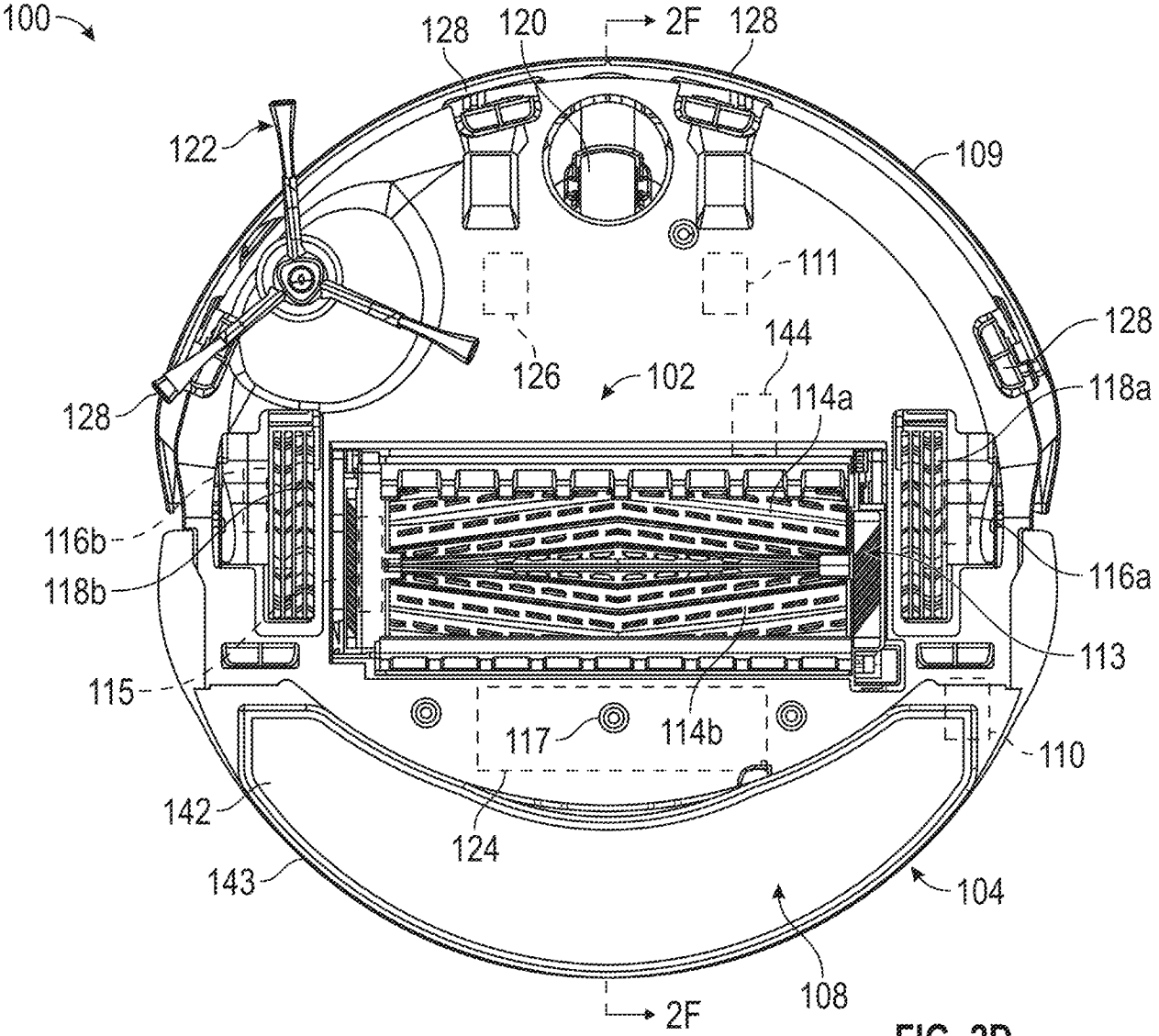
FIG. 2D illustrates a bottom view of a mobile cleaning robot in a third condition.
Figure 2E:
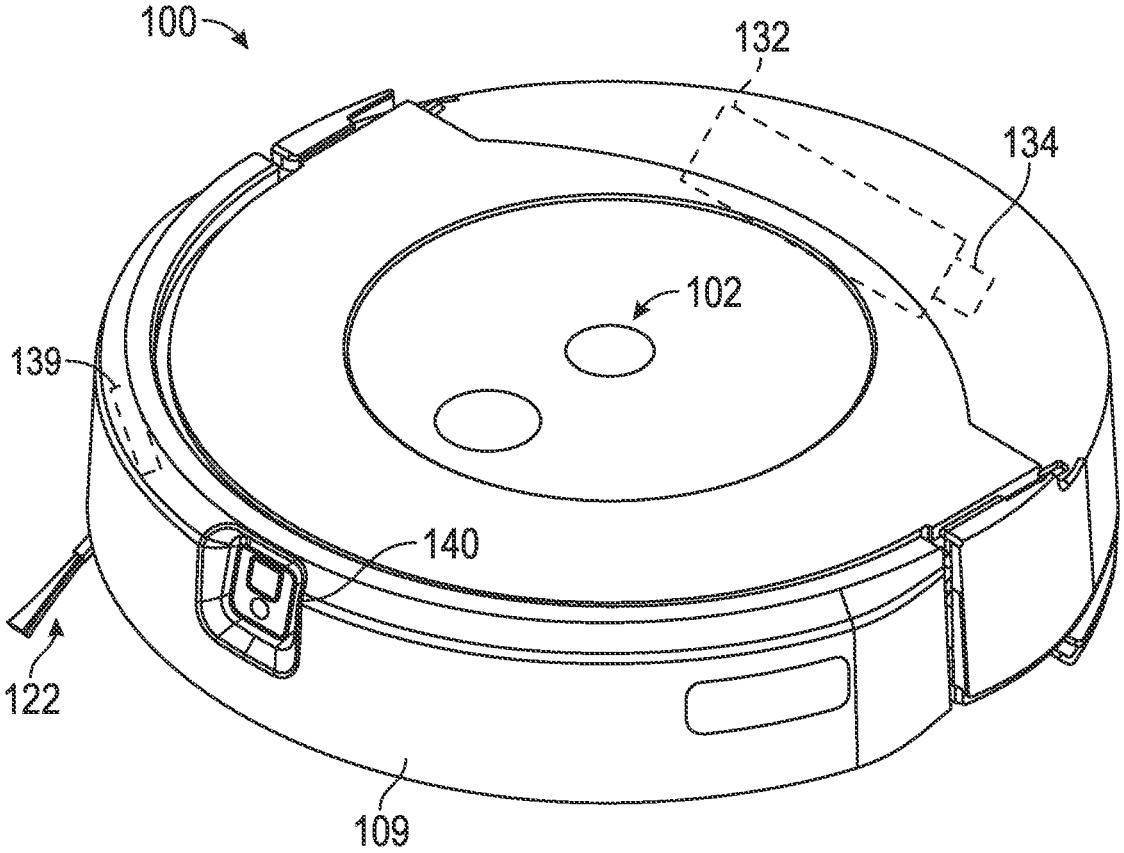
FIG. 2E illustrates a top isometric view of a mobile cleaning robot in a third condition.

FIGS. 2A-2C show how the robot 100 can be operated to move the pad assembly 108 from a stored position in FIG. 2A to a transition or partially deployed position in FIG. 2B, to a mopping or a deployed position in FIG. 2C. In the stored position of FIG. 2A, the robot 100 can perform only vacuuming operations. In the deployed position of FIG. 2C, the robot 100 can perform vacuuming operations or mopping operations. FIGS. 2D-2E discuss additional components of the robot 100.

Components of the Robot

FIG. 2D illustrates a bottom view of the mobile cleaning robot 100 and FIG. 2E illustrates a top isometric view of the robot 100. FIGS. 2D and 2E are discussed together below. The robot 100 of FIGS. 2D and 2E can be consistent with FIGS. 2A-2C; FIGS. 2D-2E show additional details of the robot 100. For example, FIGS. 2D-2E show that the robot 100 can include a body 102, a bumper 109, an extractor 113 (including rollers 114*a* and 114*b*), motors 116*a* and 116*b*, drive wheels 118*a* and 118*b*, a caster 120, a side brush assembly 122, a vacuum assembly 124, memory 126, and sensors 128. The mopping system 104 can also include a tank 132 and a pump 134.

The cleaning robot 100 can be an autonomous cleaning robot that can autonomously traverse the floor surface 50 (of FIG. 1) while ingesting the debris from different parts of the floor surface 50. As shown in FIG. 2D, the robot 100 can include the body 102 that can be movable across the floor surface 50. The body 102 can include multiple connected structures to which movable or fixed components of the cleaning robot 100 are mounted. The connected structures can include, for example, an outer housing to cover internal components of the cleaning robot 100, a chassis to which the drive wheels 118*a* and 118*b* and the cleaning rollers 114*a* and 114*b* (of the cleaning assembly 113) are mounted, and the bumper 109 connected to the outer housing. The caster wheel 120 can support the front portion of the body 102 above the floor surface 50, and the drive wheels 118*a* and 118*b* can support the middle and rear portions of the body 102 (and can also support a majority of the weight of the robot 100) above the floor surface 50.

As shown in FIG. 2D, the body 102 can include a front portion that can have a substantially semicircular shape and that can be connected to the bumper 109. The body 102 can also include a rear portion that has a substantially semicircular shape. In other examples, the body 102 can have other shapes such as a square front or straight front. The robot 100 can also include a drive system including the actuators (e.g., motors) 116*a* and 116*b*. The actuators 116*a* and 116*b* can be connected to the body 102 and can be operably connected to the drive wheels 118*a* and 118*b*, which can be rotatably mounted to the body 102. The actuators 116*a* and 116*b*, when driven, can rotate the drive wheels 118*a* and 118*b* to enable the robot 100 to autonomously move across the floor surface 50.

The vacuum assembly 124 can be located at least partially within the body 102 of the robot 100, such as in a rear portion of the body 102, and the vacuum assembly 124 can be located in other locations in other examples. The vacuum assembly 124 can include a motor to drive an impeller to generate the airflow when rotated. The airflow from the vacuum assembly 124 and the cleaning rollers 114, when rotated, can cooperate to ingest the debris into the robot 100.

The cleaning bin 130 (shown in FIG. 2F) can be mounted in the body 102 and can contain the debris ingested by the robot 100. A filter in the body 102 can separate the debris from the airflow before the airflow enters the vacuum assembly 124 and is exhausted out of the body 102. In this regard, the debris can be captured in both the cleaning bin 130 and the filter before the airflow is exhausted from the body 102. In some examples, the vacuum assembly 124 and extractor 113 can be optionally included or can be of a different type. Optionally, the vacuum assembly 124 can be operated during mopping operations, such as those including the mopping system 104. That is, the robot 100 can perform simultaneous vacuuming and mopping missions or operations.

The cleaning rollers 114*a* and 114*b* can be operably connected to an actuator 115, e.g., a motor, through a gearbox. The cleaning head 113 and the cleaning rollers 114*a* and 114*b* can be located forward of the cleaning bin 130. The cleaning rollers 114 can be mounted or connected to an underside of the body 102 so that the cleaning rollers 114*a* and 114*b* can engage debris on the floor surface 50 during the cleaning operation when the underside of the body 102 faces the floor surface 50.

The controller 111 can be located at least partially within the housing 102 and can be a programable controller, such as a single or multi-board computer, a direct digital controller (DDC), a programable logic controller (PLC), or the like. In other examples, the controller 111 can be any computing device, such as a handheld computer, for example, a smart phone, a tablet, a laptop, a desktop computer, or any other computing device including a processor, memory, and communication capabilities. The memory 126 can be one or more types of memory, such as volatile or non-volatile memory, read-only memory (ROM), random-access memory (RAM), magnetic disk storage media, optical storage media, flash-memory devices, and other storage devices and media. The memory 126 can be located within the housing 102, can be connected to the controller 111, and can be accessible by the controller 111.

The controller 111 can operate the actuators 116*a* and 116*b* to autonomously navigate the robot 100 about the floor surface 50 during a cleaning operation. The actuators 116*a* and 116*b* can be operable to drive the robot 100 in a forward drive direction, in a backwards direction, and to turn the robot 100. The controller 111 can operate the vacuum assembly 124 to generate an airflow that flows through an air gap near the cleaning rollers 114, through the body 102, and out of the body 102.

The robot 100 can include a sensor system including one or more sensors. The sensor system, as described herein, can generate one or more signal indicative of a current location of the robot 100, and can generate signals indicative of locations of the robot 100 as the robot 100 travels along the floor surface 50. The sensors 128 (shown in FIG. 2A) can be located along a bottom portion of the housing 102. Each of the sensors 128 can be an optical sensor that can be configured to detect a presence or absence of an object below the optical sensor, such as the floor surface 50. The sensors 128 (optionally cliff sensors) can be connected to the controller 111 and can be used by the controller 111 to navigate the robot 100 within the environment 40. In some examples, the cliff sensors can be used to detect a floor surface type which the controller 111 can use to selectively operate the mopping system 104.

The cleaning pad assembly 108 can be a cleaning pad connected to the bottom portion of the body 102 (or connected to the actuator 110 that can be configured to move the assembly 108 between a stored position and a cleaning position), such as to the cleaning bin 130 in a location to the rear of the extractor 113. The tank 132 can be a water tank configured to store water or fluid, such as cleaning fluid, for delivery to a mopping pad 142. The pump 134 can be connected to the controller 111 and can be in fluid communication with the tank 132. The controller 111 can be configured to operate the pump 134 to deliver fluid to the mopping pad 142 during mopping operations. For example, fluid can be delivered through one or more dispensers 117 to the mopping pad 142. The dispenser(s) 117 can be a valve, opening, or the like and can be configured to deliver fluid to the floor surface 50 of the environment 40 or to the pad 142 directly. In some examples, the pad 142 can be a dry pad such as for dusting or dry debris removal. The pad 142 can be supported by a pad tray 143 connected to the arm 106. The mopping pad 142 can also be any cloth, fabric, or the like configured for cleaning (either wet or dry) of a floor surface.

Figure 2F:
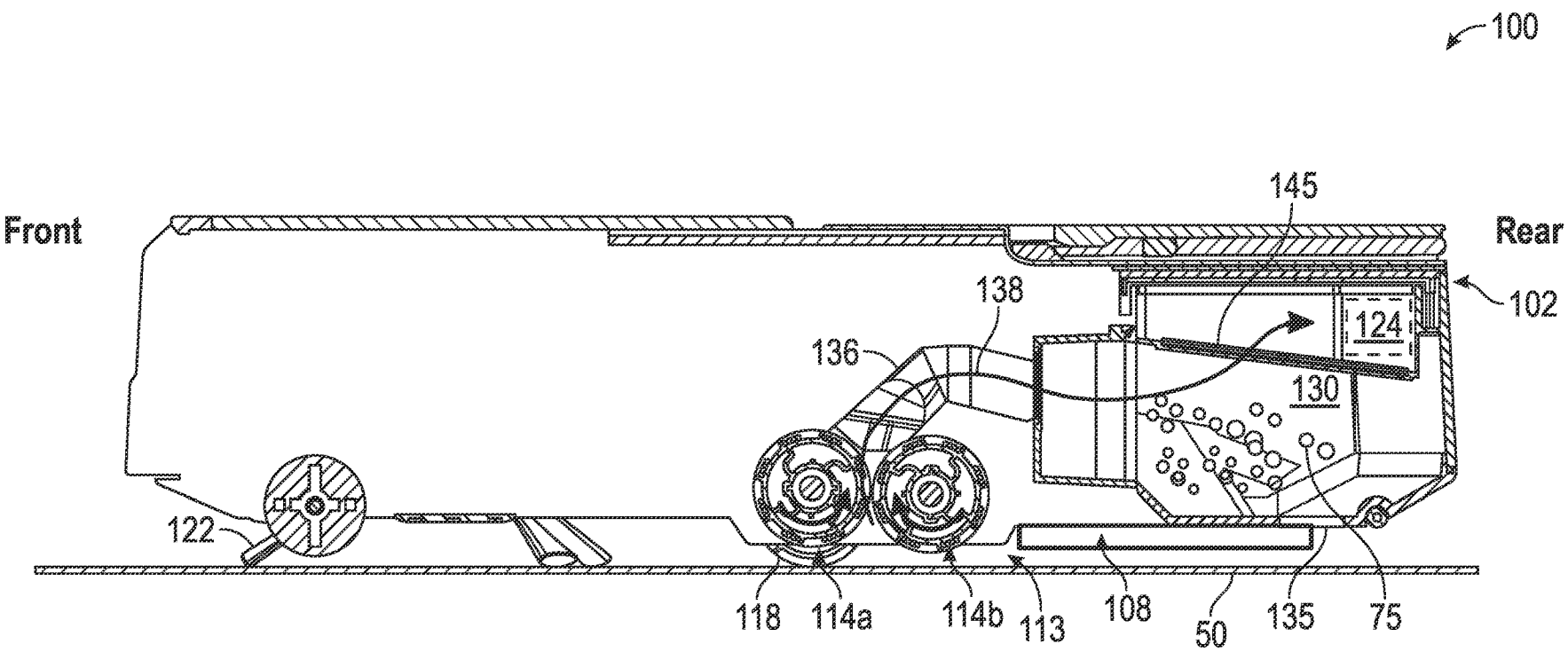
FIG. 2F illustrates a side cross-sectional view of a mobile cleaning robot in a first condition.

As shown in FIG. 2F, the vacuum assembly 124 can be located at least partially within the body 102 of the robot 100, e.g., in the rear portion of the body 102. The controller 111 can operate the vacuum assembly 124 to generate an airflow that flows through the air gap near the cleaning rollers 114, through the body 102, and out of the body 102. The airflow and the cleaning rollers 114, when rotated, can cooperate to ingest debris 75 into a suction duct 136 of the robot 100. The suction duct 136 can extend down to or near a bottom portion of the body 102 and can be at least partially defined by the cleaning assembly 113.

The suction duct 136 can be connected to the cleaning head 113 or cleaning assembly and can be connected to a cleaning bin 130. The cleaning bin 130 can be mounted in the body 102 and can contain the debris 75 ingested by the robot 100. A filter 145 can be located in the body 102, which can help to separate the debris 75 from the airflow before the airflow 138 enters the vacuum assembly 124 and is exhausted out of the body 102. In this regard, the debris 75 can be captured in both the cleaning bin 130 and the filter before the airflow 138 is exhausted from the body 102. The robot 100 can also include a debris port 135 that can extend at least partially through the body 102 or the cleaning bin 130 and can be operable to remove the debris 75 from the cleaning bin 130, such as via a docking station or evacuation station.

The cleaning rollers 114*a* and 114*b* can operably connected to one or more actuators 115, e.g., motors, respectively. The cleaning head 113 and the cleaning rollers 114*a* and 114*b* can be positioned forward of the cleaning bin 130. The cleaning rollers 114*a* and 114*b* can be mounted to a housing of the cleaning head 113 and mounted, e.g., indirectly or directly, to the body 102 of the robot 100. In particular, the cleaning rollers 114*a* and 114*b* can be mounted to an underside of the body 102 so that the cleaning rollers 114*a* and 114*b* engage debris 75 on the floor surface 50 during the cleaning operation when the underside faces the floor surface 50.

Operation of the Robot

In operation of some examples, the controller 111 can be used to instruct the robot 100 to perform a mission. In such a case, the controller 111 can operate the motors 116 to drive the drive wheels 118 and propel the robot 100 along the floor surface 50. The robot 100 can be propelled in a forward drive direction or a rearward drive direction. The robot 100 can also be propelled such that the robot 100 turns in place or turns while moving in the forward drive direction or the rearward drive direction. In addition, the controller 111 can operate the motors 115 to cause the rollers 114*a* and 114*b* to rotate, can operate the side brush assembly 122, and can operate the motor of the vacuum system 124 to generate airflow. The controller 111 can execute software stored on the memory 126 to cause the robot 100 to perform various navigational and cleaning behaviors by operating the various motors of the robot 100.

The various sensors of the robot 100 can be used to help the robot navigate and clean within the environment 40. For example, the cliff sensors can detect obstacles such as drop-offs and cliffs below portions of the robot 100 where the cliff sensors are disposed. The cliff sensors can transmit signals to the controller 111 so that the controller 111 can redirect the robot 100 based on signals from the sensors.

Proximity sensors can produce a signal based on a presence or the absence of an object in front of the optical sensor.

For example, detectable objects include obstacles such as furniture, walls, persons, and other objects in the environment 40 of the robot 100. The proximity sensors can transmit signals to the controller 111 so that the controller 111 can redirect the robot 100 based on signals from the proximity sensors. In some examples, a bump sensor can be used to detect movement of the bumper 109 along a fore-aft axis of the robot 100. A bump sensor 139 can also be used to detect movement of the bumper 109 along one or more sides of the robot 100 and can optionally detect vertical bumper movement. The bump sensors 139 can transmit signals to the controller 111 so that the controller 111 can redirect the robot 100 based on signals from the bump sensors 139.

The robot 100 can also optionally include one or more dirt sensors 144 connected to the body 102 and in communication with the controller 111. The dirt sensors 144 can be a microphone, piezoelectric sensor, optical sensor, or the like located in or near a flow path of debris, such as near an opening of the cleaning rollers 114 or in one or more ducts within the body 102. This can allow the dirt sensor(s) 144 to detect how much dirt is being ingested by the vacuum assembly 124 (e.g., via the extractor 113) at any time during a cleaning mission. Because the robot 100 can be aware of its location, the robot 100 can keep a log or record of which areas or rooms of the map are dirtier or where more dirt is collected.

The image capture device 140 can be configured to generate a signal based on imagery of the environment 40 of the robot 100 as the robot 100 moves about the floor surface 50. The image capture device 140 can transmit such a signal to the controller 111. The controller 111 can use the signal or signals from the image capture device 140 for various tasks, algorithms, or the like, as discussed in further detail below.

In some examples, the obstacle following sensors can detect detectable objects, including obstacles such as furniture, walls, persons, and other objects in the environment of the robot 100. In some implementations, the sensor system can include an obstacle following sensor along the side surface, and the obstacle following sensor can detect the presence or the absence an object adjacent to the side surface. The one or more obstacle following sensors can also serve as obstacle detection sensors, similar to the proximity sensors described herein.

The robot 100 can also include sensors for tracking a distance travelled by the robot 100. For example, the sensor system can include encoders associated with the motors 116 for the drive wheels 118, and the encoders can track a distance that the robot 100 has travelled. In some implementations, the sensor can include an optical sensor facing downward toward a floor surface. The optical sensor can be positioned to direct light through a bottom surface of the robot 100 toward the floor surface 50. The optical sensor can detect reflections of the light and can detect a distance travelled by the robot 100 based on changes in floor features as the robot 100 travels along the floor surface 50.

The controller 111 can use data collected by the sensors of the sensor system to control navigational behaviors of the robot 100 during the mission. For example, the controller 111 can use the sensor data collected by obstacle detection sensors of the robot 100, (the cliff sensors, the proximity sensors, and the bump sensors) to enable the robot 100 to avoid obstacles within the environment of the robot 100 during the mission.

The sensor data can also be used by the controller 111 for simultaneous localization and mapping (SLAM) techniques in which the controller 111 extracts features of the environment represented by the sensor data and constructs a map of the floor surface 50 of the environment. The sensor data collected by the image capture device 140 can be used for techniques such as vision-based SLAM (VSLAM) in which the controller 111 extracts visual features corresponding to objects in the environment 40 and constructs the map using these visual features. As the controller 111 directs the robot 100 about the floor surface 50 during the mission, the controller 111 can use SLAM techniques to determine a location of the robot 100 within the map by detecting features represented in collected sensor data and comparing the features to previously stored features. The map formed from the sensor data can indicate locations of traversable and nontraversable space within the environment. For example, locations of obstacles can be indicated on the map as nontraversable space, and locations of open floor space can be indicated on the map as traversable space.

The sensor data collected by any of the sensors can be stored in the memory 126. In addition, other data generated for the SLAM techniques, including mapping data forming the map, can be stored in the memory 126. These data produced during the mission can include persistent data that are produced during the mission and that are usable during further missions. In addition to storing the software for causing the robot 100 to perform its behaviors, the memory 126 can store data resulting from processing of the sensor data for access by the controller 111. For example, the map can be a map that is usable and updateable by the controller 111 of the robot 100 from one mission to another mission to navigate the robot 100 about the floor surface 50.

The persistent data, including the persistent map, can help to enable the robot 100 to efficiently clean the floor surface 50. For example, the map can enable the controller 111 to direct the robot 100 toward open floor space and to avoid nontraversable space. In addition, for subsequent missions, the controller 111 can use the map to optimize paths taken during the missions to help plan navigation of the robot 100 through the environment 40.

The controller 111 can also send commands to a motor or actuator 110 (shown in FIG. 2A) that can be connected to the arms 106 and can be located at least partially within the body 102, where the command(s) can drive the arms 106 to move the pad assembly 108 between the stored position (shown in FIGS. 2A and 2D) and the deployed position (shown in FIGS. 2C and 2E). In the deployed position, the pad assembly 108 (the mopping pad 142) can be used to mop a floor surface of any room of the environment 40.

The mopping pad 142 can be a dry pad or a wet pad. Optionally, when the mopping pad 142 is a wet pad, the pump 134 can be operated by the controller 111 to spray or drop fluid (e.g., water or a cleaning solution) onto the floor surface 50 or the mopping pad 142. The wetted mopping pad 142 can then be used by the robot 100 to perform wet mopping operations on the floor surface 50 of the environment 40.

Network Examples

Figure 2G:
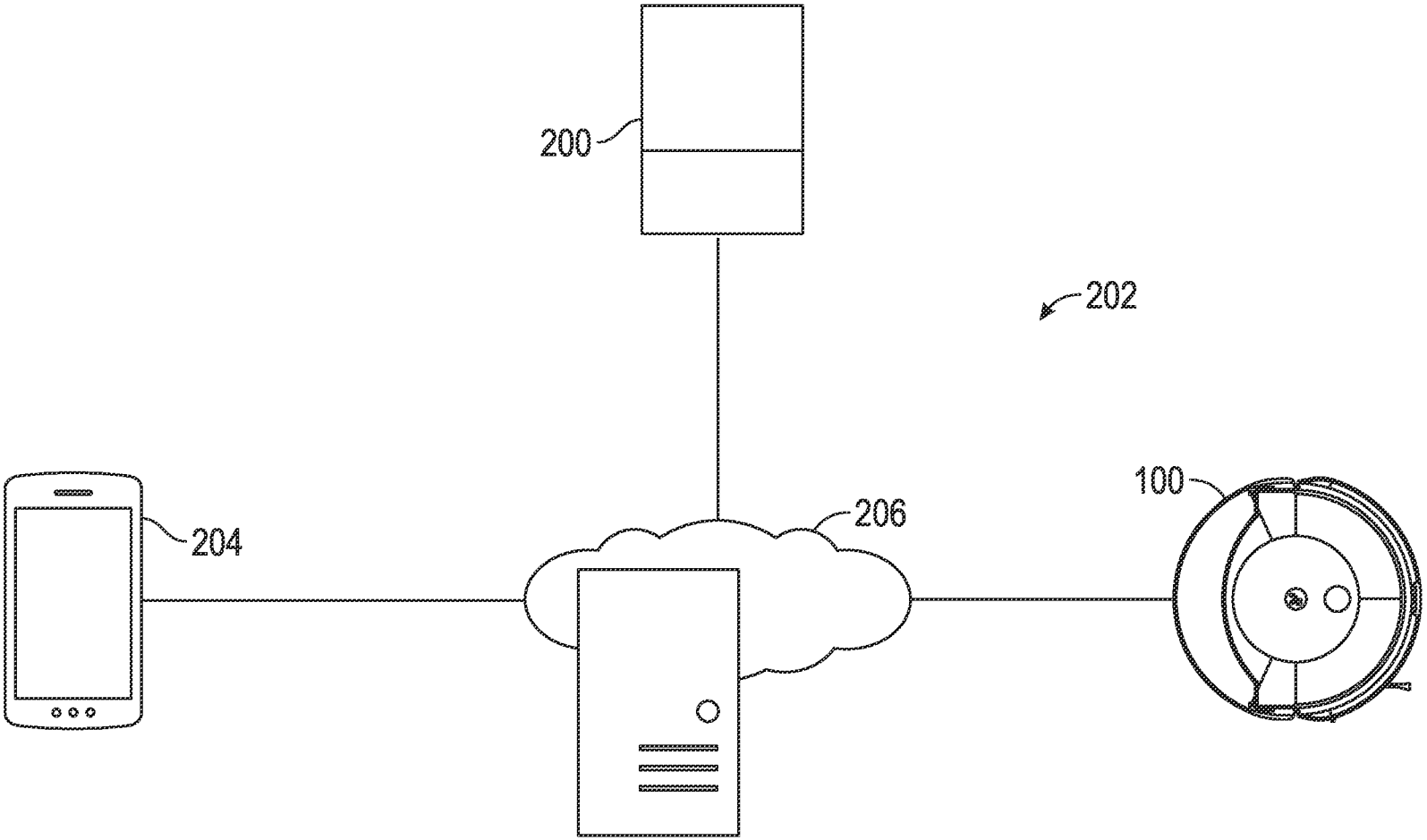
FIG. 2G illustrates a diagram illustrating an example of a communication network in which a mobile cleaning robot operates and data transmission in the network.

FIG. 2G is a diagram showing a communication network 202 that enables networking between the mobile robot 100 and one or more other devices, a docking station 200 (or any of the docking stations discussed herein), a mobile device 304 (including a controller), a cloud computing system 306 (including a controller), or another autonomous robot separate from the mobile robot 100. Using the communication network 202, the robot 100, the mobile device 304, the docking station 200, and the cloud computing system 306 can communicate with one another to transmit and receive data from one another. In some examples, the robot 100, the docking station 200, or both the robot 100 and the docking station 200 can communicate with the mobile device 304 through the cloud computing system 306. Alternatively, or additionally, the robot 100, the docking station 200, or both the robot 100 and the docking station 200 can communicate directly with the mobile device 304. Various types and combinations of wireless networks (e.g., Bluetooth, radio frequency, optical based, etc.) and network architectures (e.g., wi-fi or mesh networks) can be employed by the communication network 202.

In some examples, the mobile device 304 can be a remote device that can be linked to the cloud computing system 306 and can enable a user to provide inputs. The mobile device 304 can include user input elements such as, for example, one or more of a touchscreen display, buttons, a microphone, a mouse, a keyboard, or other devices that respond to inputs provided by the user. The mobile device 304 can also include immersive media (e.g., virtual reality or augmented reality) with which the user can interact to provide input. The mobile device 304, in these examples, can be a virtual reality headset or a head-mounted display.

The user can provide inputs corresponding to commands for the mobile robot 100. In such cases, the mobile device 304 can transmit a signal to the cloud computing system 306 to cause the cloud computing system 306 to transmit a command signal to the mobile robot 100. In some implementations, the mobile device 304 can present augmented reality images. In some implementations, the mobile device 304 can be a smart phone, a laptop computer, a tablet computing device, or other mobile device.

In some examples, the communication network 202 can include additional nodes. For example, nodes of the communication network 202 can include additional robots. Also, nodes of the communication network 202 can include network-connected devices that can generate information about the environment 40. Such a network-connected device can include one or more sensors, such as an acoustic sensor, an image capture system, or other sensor generating signals, to detect characteristics of the environment 40 from which features can be extracted. Network-connected devices can also include home cameras, smart sensors, or the like.

In the communication network 202, the wireless links can utilize various communication schemes, protocols, etc., such as, for example, Bluetooth classes, Wi-Fi, Bluetooth-low-energy, also known as BLE, 802.15.4, Worldwide Interoperability for Microwave Access (WiMAX), an infrared channel, satellite band, or the like. In some examples, wireless links can include any cellular network standards used to communicate among mobile devices, including, but not limited to, standards that qualify as 1G, 2G, 3G, 4G, 5G, or the like. The network standards, if utilized, qualify as, for example, one or more generations of mobile telecommunication standards by fulfilling a specification or standards such as the specifications maintained by International Telecommunication Union. For example, the 4G standards can correspond to the International Mobile Telecommunications Advanced (IMT-Advanced) specification. Examples of cellular network standards include AMPS, GSM, GPRS, UMTS, LTE, LTE Advanced, Mobile WiMAX, and WiMAX-Advanced. Cellular network standards can use various channel access methods, e.g., FDMA, TDMA, CDMA, or SDMA.

Standard Suspension Example

Figure 3B:
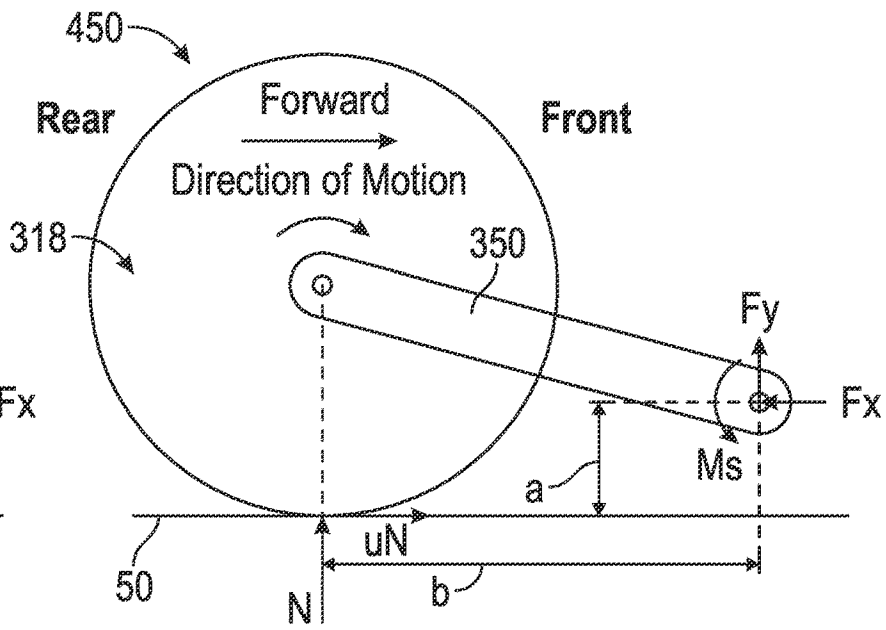
FIG. 3B illustrates a schematic view of a portion of a mobile cleaning robot.
Figure 3A:
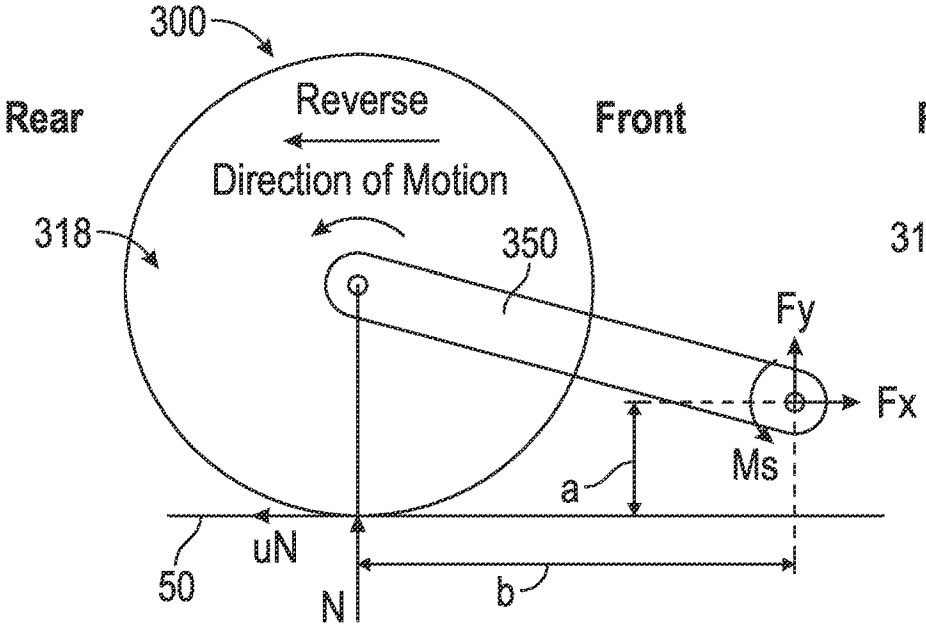
FIG. 3A illustrates a schematic view of a portion of a mobile cleaning robot.

FIG. 3A illustrates a schematic view of a portion of a mobile cleaning robot 300. FIG. 3B illustrates a schematic view of a portion of the mobile cleaning robot 300. FIGS. 3A and 3B show an example of a mobile cleaning robot including a drive wheel 318 connected to a body of the mobile cleaning robot 300 via a front-pivot drive arm 350. FIGS. 3A and 3B show a flooring surface and show a force in a vertical direction Fy and a force in a horizontal direction Fx. FIGS. 3A and 3B also show a direction of motion and a reaction force normal to the wheel, N.

In operation of the mobile cleaning robot 300, the dimension a can be a moment arm to which a traction force uN (or thrust) of the drive wheel 318 is applied, which can create a moment that can add or subtract from a spring moment Ms. In such a design, the dimension a is usually much larger than zero to allow the arm 352 and its pivot to remain with the body of the robot. Also, the dimension a can increase as the drive wheel 318 is deployed or extended, increasing the size of the moment Ms, which can add to or subtract from the thrust force uN, depending on the direction of the robot. For example, as shown in FIG. 3A, when the robot 300 is moving in reverse, the traction force uN can create a moment about the arm (distance) a, forming counterclockwise moment about the pivot, which is opposite the spring moment MS, effectively decreasing the total downforce. Conversely, when the robot 300 is moving forward, the traction force uN can create a moment about the arm (distance) a, forming clockwise moment about the pivot, which is in the same direction as the spring moment MS, effectively increasing the downforce during forward movement. This difference can create traction issues, especially as the drive wheel 318 extends from the body and as the mobile cleaning robot 300 moves in reverse. The examples below can help to address these issues.

Suspension Examples

Figure 4:
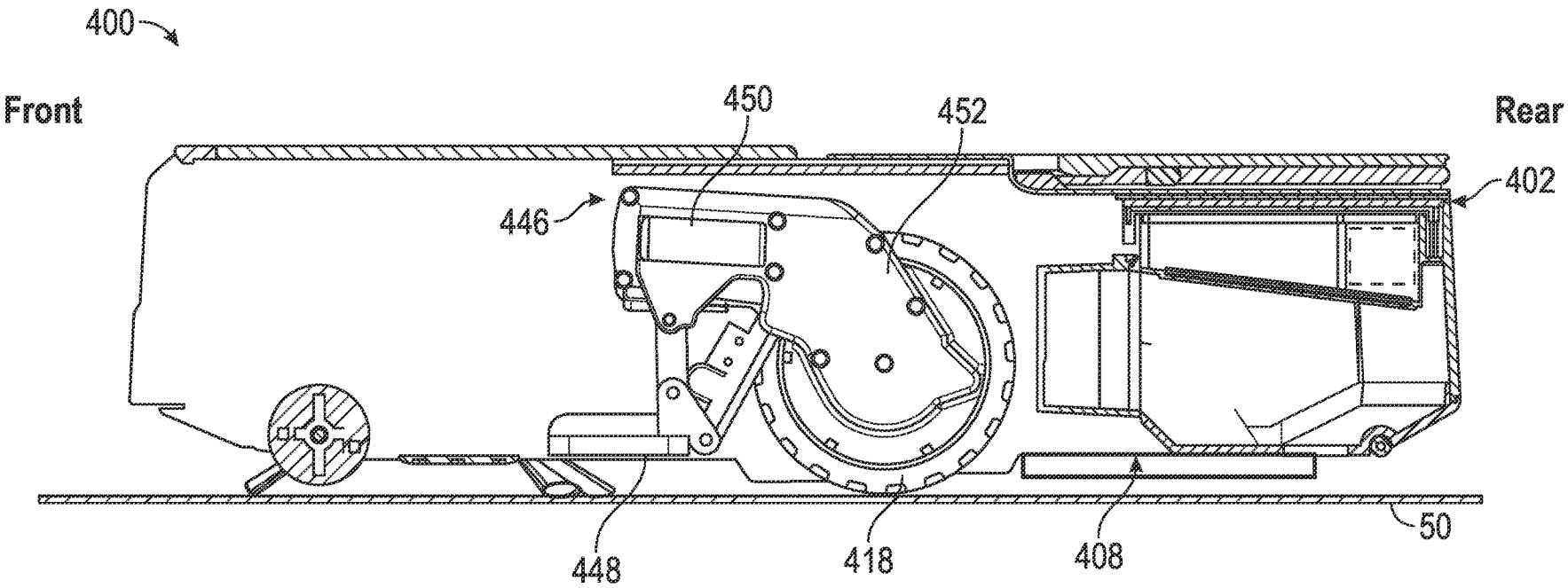
FIG. 4 illustrates a cross-section view of a portion of a mobile cleaning robot.

FIG. 4 illustrates a cross-section view of a portion of a mobile cleaning robot 400. The mobile cleaning robot 400 can be similar to the robot 100 discussed above such that like components can have like reference numerals. For example, the mobile cleaning robot 400 can include a body 402, a cleaning pad assembly 408, a drive wheel 418, a side brush 422, or the like. FIG. 4 shows that the mobile cleaning robot 400 can include a wheel module 446 including the drive wheel 418, a mount 448, a motor 450 (which can be similar to the motors 116), and a drive arm 452.

The wheel module 446 can be connected to the body 402 via the mount 448, which can be a component of the body 402, a component of the wheel module 446, or can be integrated into either the wheel module 446 or the body 402. Optionally, the mount 448 can be omitted and the wheel module 446 can connect directly to the body 402. The drive arm 452 can include one or more gears (such as a drive train) engaged with a drive shaft of the motor and with the drive wheel 418 to translate rotation of the motor 450 into rotation of the drive wheel. The drive train can optionally be enclosed by a housing. Optionally, the drive arm can include no gears such that the drive wheel 418 is directly driven by the motor 450.

In operation, the wheel module 446 can be configured to cause rotation of the drive wheel 418 with respect to the body 402 to allow the drive wheel 418 (or another drive wheel 418) to move the body 402 about the floor surface 50 and about the environment 40. The wheel module 446 can also include a linkage assembly 453 that can allow the drive wheel 418 to move with respect to the body 402, such as between an extended position and a retracted position (shown in FIG. 4), as discussed in further detail below.

Figure 5A:
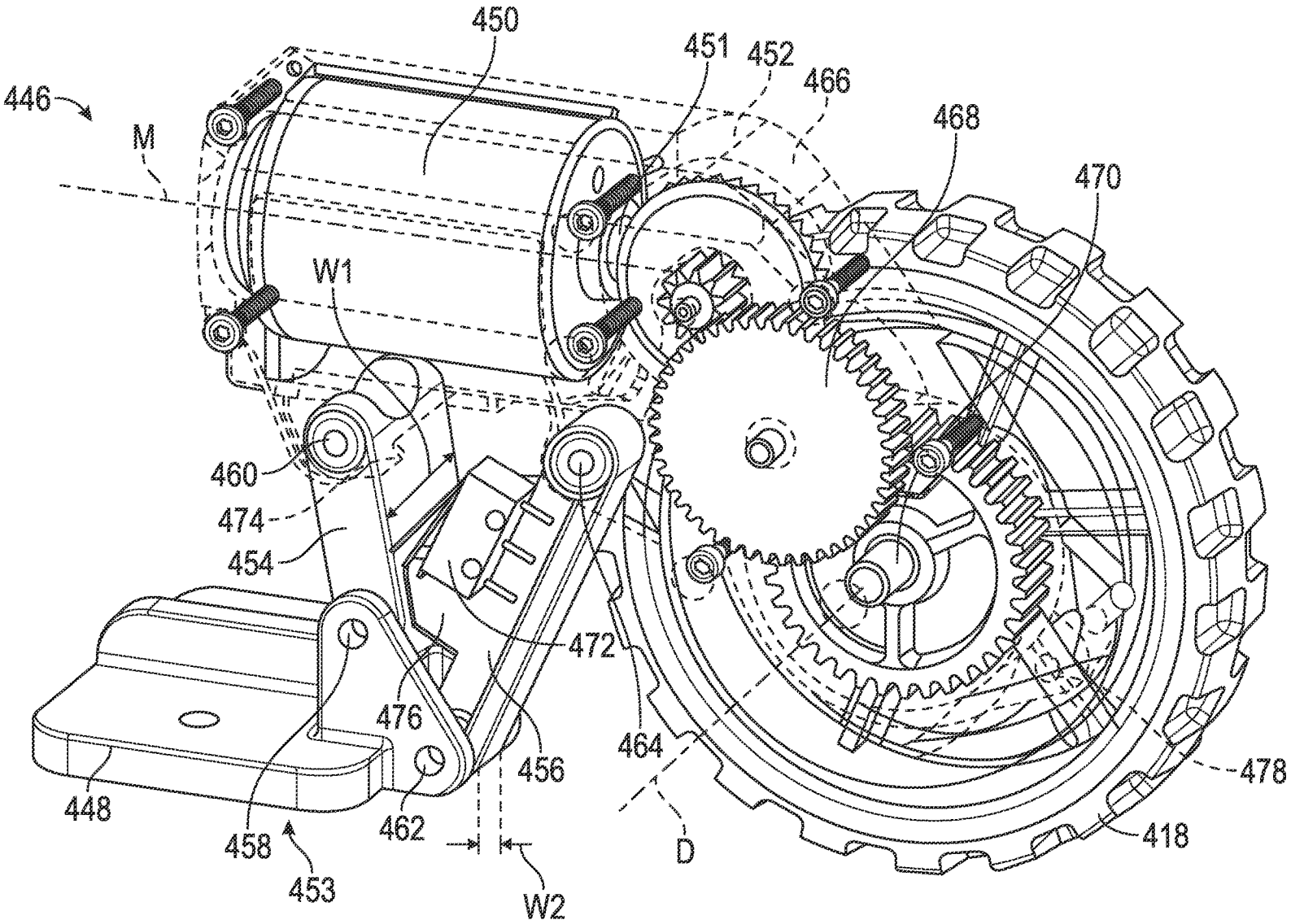
FIG. 5A illustrates an isometric view of a portion of a mobile cleaning robot in a first condition.
Figure 5B:
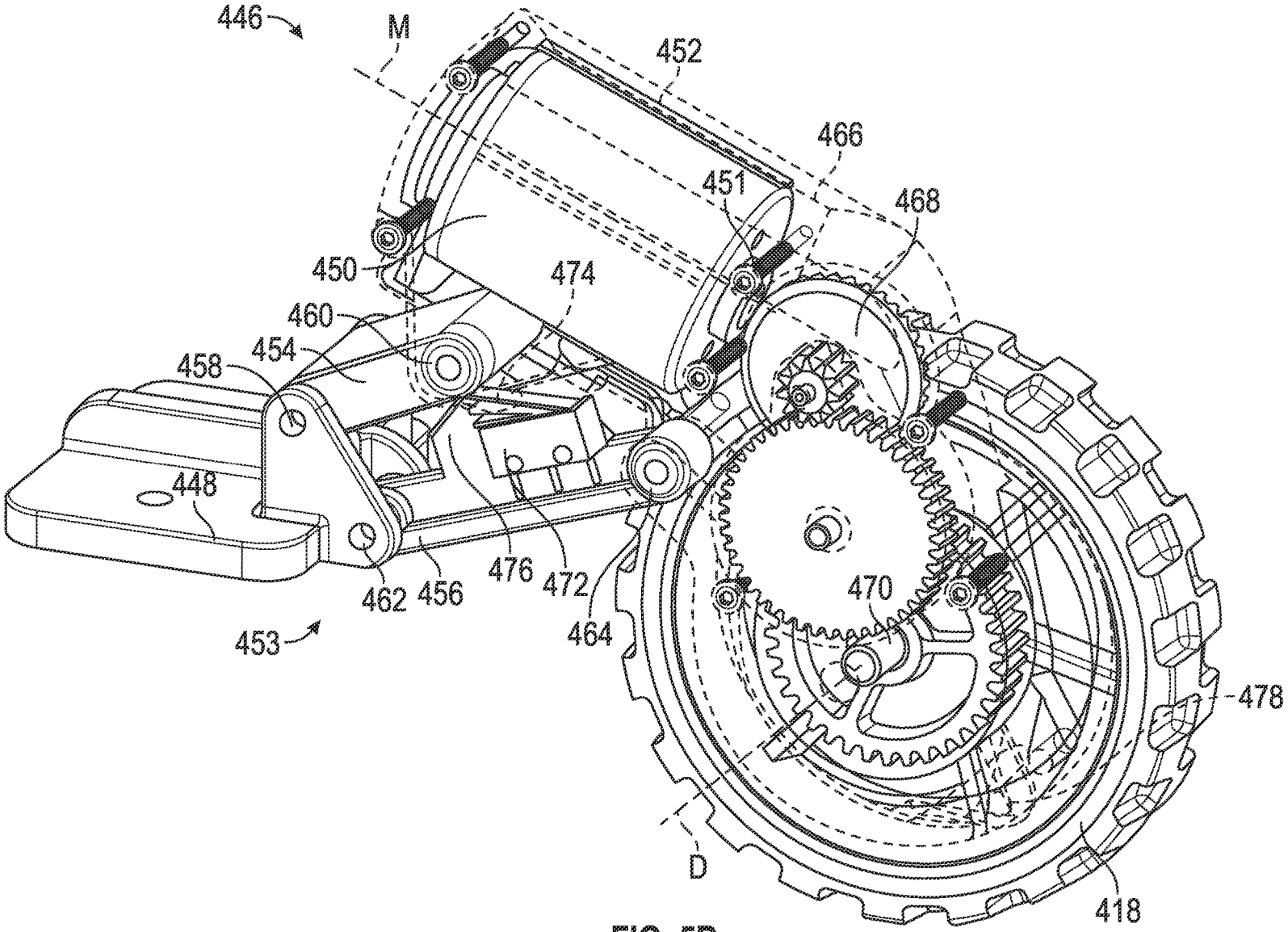
FIG. 5B illustrates an isometric view of a portion of a mobile cleaning robot in a second condition.

FIG. 5A illustrates an isometric view of the wheel module 446 of the mobile cleaning robot 400 in a retracted position. FIG. 5B illustrates an isometric view of the wheel module 446 of the mobile cleaning robot 400 in an extended position. FIGS. 5A and 5B also show a drive axis D. FIGS.

5A and 5B are discussed together below. The wheel module 446 of FIGS. 5A and 5B can be consistent with FIG. 4. FIGS. 5A and 5B show additional details of the wheel module 446.

For example, FIGS. 5A and 5B show that the wheel module 446 can include the linkage assembly 453 including a first link 454 and a second link 456. The first link 454 can be pivotably coupled to the mount 448 by a pivot 458 and the first link 454 can be pivotably coupled to the drive arm 452 by a pivot 460. The second link 456 can be pivotably coupled to the mount 448 by a pivot 462 and the second link 456 can be pivotably coupled to the drive arm 452 by a pivot 464. The links and the pivots together can allow the drive arm 452 to be pivotably connected to the body 402. The pivot connections of the first link 454 and the second link 456 can be located below the motor 450 or below the drive wheel axis D of the drive wheel 418 when the drive wheel is in the retracted position. The pivots can include bearings, bushings, or the like, configured to allow relative rotation of the links and the drive arm 452.

The first link 454 can have a first width W1 and the second link 456 can have a second width W2 that is smaller than the first width. This can allow the first link 454 to handle axial loads as well as lateral loads (or moments) while the second link 456 can handle primarily axial loads (e.g., a two-force member) while helping to guide rotation of the drive arm 452. Because the second link 456 does not resist lateral loads as much as the first link 454, the second link 456 can allow for some lateral movement of the second link 456, helping to avoid over-constraining the linkage assembly 453.

FIGS. 5A and 5B also show that the drive arm 452 can include a housing 466 that can be connected to the first link 454 and the second link 456 (e.g., via the pivot 460 and the pivot 464), such as via a pin, fastener, or the like. The housing 466 can also support the motor 450 such that the motor 450 is located at least partially within the housing 466. The housing 466 can also at least partially enclose a drive train 468 configured to translate rotation from a drive shaft of the motor 450 to a drive shaft 470 of the drive wheel 418.

The motor 450 can be oriented such that a drive shaft 451 of the motor 450 can be rotatable about a drive shaft axis M where the drive shaft axis M is perpendicular (or nearly perpendicular (e.g., within 5, 10, 15 degrees, or the like)) to the drive wheel axis D of the drive wheel 418. Such a configuration can allow the motor 450 to be packaged with the drive arm 452 in a relatively small package, helping to save space within the body 402 of the mobile cleaning robot 400.

FIGS. 5A and 5B also show that the wheel module 446 can include a switch 472 (e.g., a limit switch) connected to the second link 456. The switch 472 can be in communication with a controller (e.g., the controller 111). The drive arm 452 can also include a projection 474 extending at least partially from the housing 466 and engageable with the switch 472 when the drive wheel 418 reaches the extended position.

In operation, the motor 450 can rotate its drive shaft 451 to operate the drive train 468 to rotate the drive wheel 418 about the drive shaft 470 to move the mobile cleaning robot 400 about an environment. The linkage assembly 453 can allow the drive wheel 418 to move between the retracted position (shown in FIG. 5A) and the extended position (shown in FIG. 5B) as the mobile cleaning robot 400 navigates over obstacles or different floor surfaces. For example, the drive wheel 418 can move out of the retracted position when the mobile cleaning robot 400 (e.g., the body 402) engages carpet, causing the body 402 to be lifted (which can cause the drive wheel 418 move downward or extend with respect to the body 402).

The linkage assembly 453 (e.g., the first link 454 and the second link 456) can be connected to the body 402 (e.g., via the pivot 458 and the pivot 462) and the linkage assembly 453 can be connected to the drive arm 452 (e.g., via the pivot 460 and the pivot 464) to allow a rotational center (discussed in further detail below) to be located in front of the drive wheel 418 in each position between the retracted position and the extended position and can allow the rotational center to be located below the drive shaft 470 (or at or near or below a bottom of the drive wheel 418 or the floor surface 50) in each position between the retracted position and the extended position. By locating the rotational center of the linkage assembly 453 (and the drive arm 452 and the drive wheel 418) relatively low, a relatively consistent downforce can be applied by the drive wheel 418 onto the floor surface 50, helping to improve traction and navigation of the mobile cleaning robot 400 as it moves about the environment over different obstacles and surfaces. By using a 4-bar system in the linkage assembly 453, the center C can be near the bottom of the drive wheel, which can keep the dimension a (e.g., FIG. 3A) near zero. This means that any wheel thrust cannot affect the wheel's downforce (and thus traction) regardless of drive direction.

In the same way that the linkage assembly 453 can balance forward and reverse traction (e.g., by decoupling wheel-thrust with wheel downforce), the mobile cleaning robot 400 can be less susceptible to ride-up issues (where the robot 400 climbs an obstacle in a undesired fashion or manner. Because the wheel downforce is relatively constant, the wheels 418 cannot exert upward force on the robot (which is the force that can cause ride-up.

The linkage assembly 453 can also be designed to help traverse thresholds and obstacles. When the drive wheel 418 engages an object or a threshold, it is desirable to increase downforce as much as possible. To help increase downforce when a threshold or object is engaged, the offset of the rotational center (e.g., dimension b of FIGS. 3A and 3B) can be selected such that downforce this is amplified or increased to about 100 percent of a weight of the mobile cleaning robot 400 at the instant the drive wheel 418 touches the threshold (which is the most critical point to get past).

Though, the rotational center of the linkage assembly 453 is located to provide a relatively consistent downforce, the linkage assembly 453 can be designed to provide any downforce profile.

As the drive wheel 418 reaches the extended position, the projection 474 of the drive arm 452 can engage the switch 472, activating the switch 472, and allowing the switch 472 to generate (or produce) and transmit a signal to the controller (e.g., the controller 111), such as to allow the controller to determine that the drive wheel 418 is fully extended, which can indicate that the mobile cleaning robot 400 is beached or that a cliff has been reached.

FIGS. 5A and 5B also show that the linkage assembly 453 can include a stop 476 that can extend from the second link 456 and can be engageable with the first link first link 454 such as to limit rotation of the drive wheel 418 and the drive arm 452 past the retracted position, as shown in FIG. 5A. Contact between the stop 476 and the second link 456 can also limit rotation of the drive wheel 418 and the drive arm 452 past the extended position, as shown in FIG. 5B. The stop 476 can be configured (e.g., sized and shaped), such as with a sloped surface, to engage the first link 454 in both the fully extended position and the fully retracted position such that the stop 476 limits travel of the drive wheel 418 with respect to the body 402 in both directions. FIGS. 5A and 5B also show that the mobile cleaning robot 400 can include a biasing connector 478 that can be connectable to a biasing element or member that is connected to the body 402 to bias the drive arm 452 toward the extended position. The biasing element can be an extension spring, compression spring, or the like.

Figure 6A:
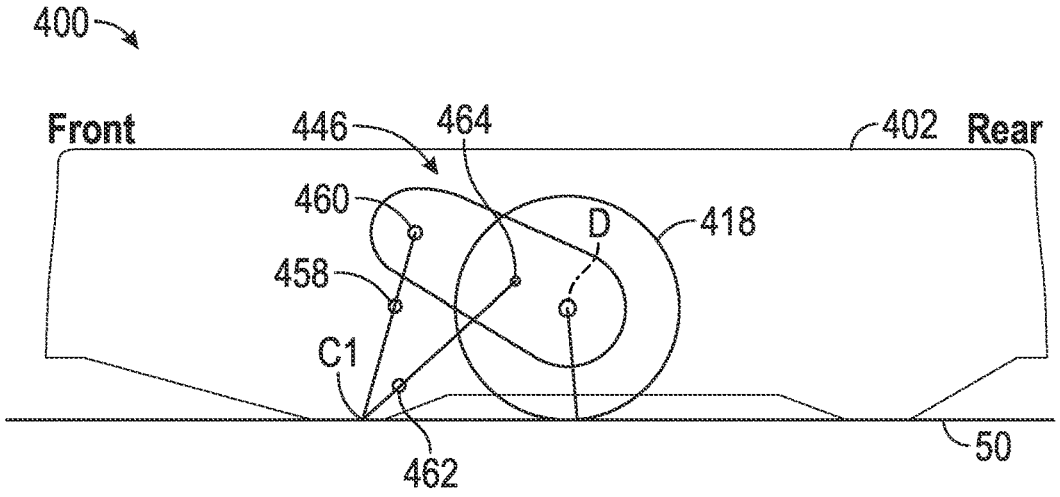
FIG. 6A illustrates a side view of a portion of a mobile cleaning robot in a first condition.
Figure 6B:
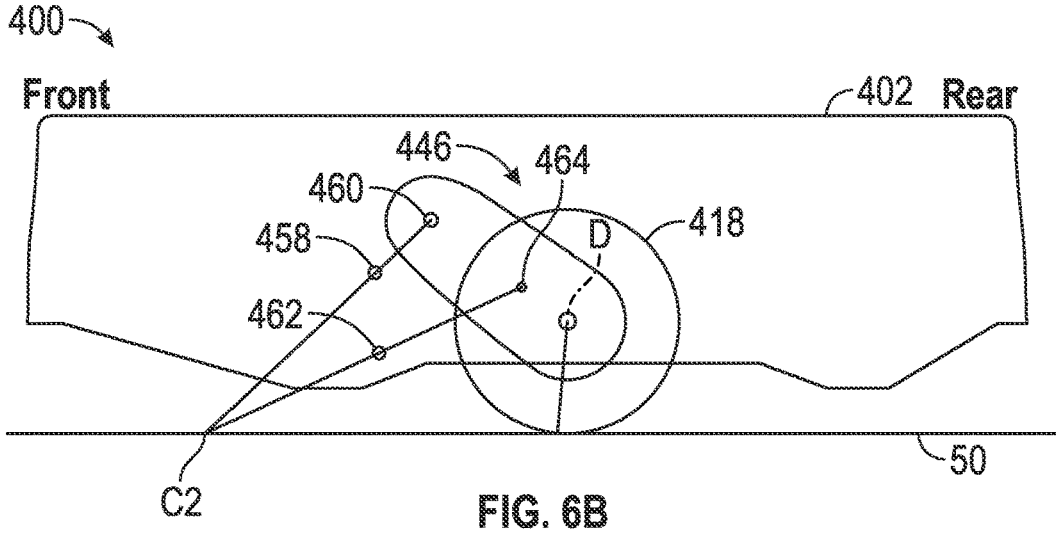
FIG. 6B illustrates a side view of a portion of a mobile cleaning robot in a second condition.
Figure 6C:
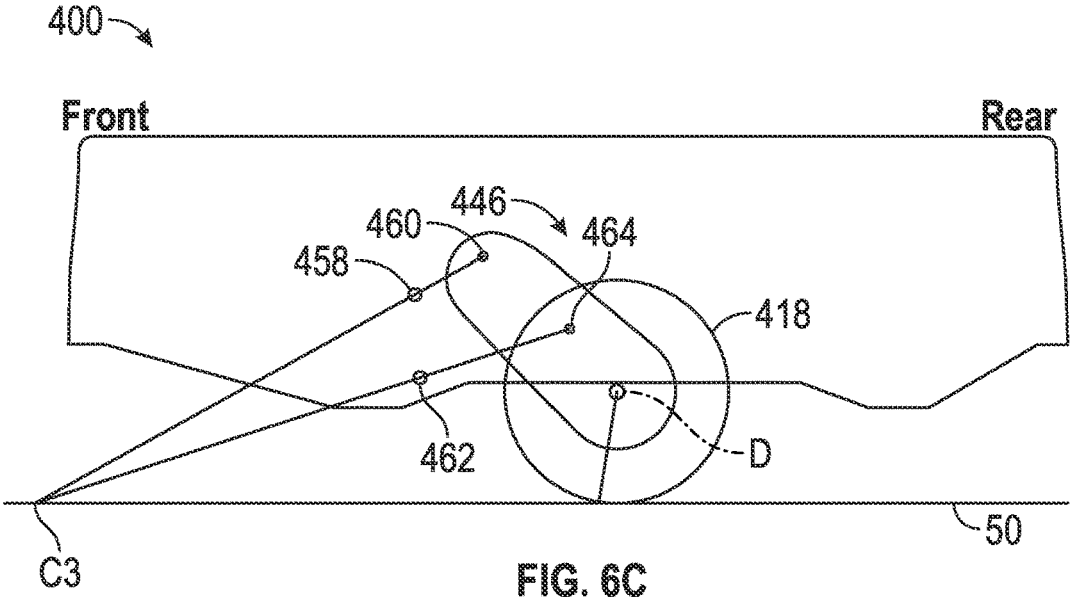
FIG. 6C illustrates a side view of a portion of a mobile cleaning robot in a third condition.

FIG. 6A illustrates a side view of a portion of the mobile cleaning robot 400 in a first condition. FIG. 6B illustrates a side view of a portion of the mobile cleaning robot 400 in a second condition. FIG. 6C illustrates a side view of a portion of the mobile cleaning robot 400 in a third condition. FIGS. 6A-6C are discussed together below. The mobile cleaning robot 400 of FIGS. 6A-6C can be consistent with the mobile cleaning robot 400 discussed above. FIGS. 6A-6B show how the linkage assembly 453 can allow a virtual center of rotation C (or virtual pivot or instantaneous center of rotation) to move as the drive wheel 418 moves between the retracted position and the extended position.

As shown in FIG. 6A, when the drive wheel 418 is an a retracted or near-retracted position, the location of the first link 454 and the second link 456 (represented by lines through their pivots 458, 460, 462, and 464) can define a center of rotation C1 at the intersection point of the lines through the first link 454 and the second link 456. As shown in FIG. 6A, the center of rotation C1 can be at or near a bottom portion of the drive wheel 418 which can be at or near the floor surface 50. In this position of extension (or retraction) of the drive wheel 418, the center of rotation C1 can also be below the drive axis D of the drive wheel 418, below the links 454 and 456, or below their pivots 458, 460, 462, and 464.

As the drive wheel 418 extends from the body 402, as shown in FIG. 6B, the center of rotation C2 can move downward such that the center of rotation C2 remains at or near a bottom portion of the drive wheel 418 which can be at or near the floor surface 50. In this position of extension of the drive wheel 418, the center of rotation C2 can also be below the drive axis D of the drive wheel 418, below the links 454 and 456, or below their pivots 458, 460, 462, and 464. And, as the drive wheel 418 extends from the body 402 further to a fully extended position (or near fully extended position) such that the body 402 is lifted off the floor surface 50, as shown in FIG. 6C, the center of rotation C3 can move further downward such that the center of rotation C3 remains at or near a bottom portion of the drive wheel 418 which can be at or near the floor surface 50. In this position of extension of the drive wheel 418, the center of rotation C3 can also be below the drive axis D of the drive wheel 418, below the links 454 and 456, or below their pivots 458, 460, 462, and 464.

By maintaining the center of rotation C at or near a bottom portion of the drive wheel 418, which can be at or near the floor surface 50 (and below most or all components of the mobile cleaning robot 400), a moment applied due to traction forces can be minimized and a higher (or relatively constant or desired) downforce can be maintained throughout the range of travel of the drive wheel 418, helping to maintain consistent traction of the drive wheel(s) 418 between forward and reverse directions.

Figure 7:
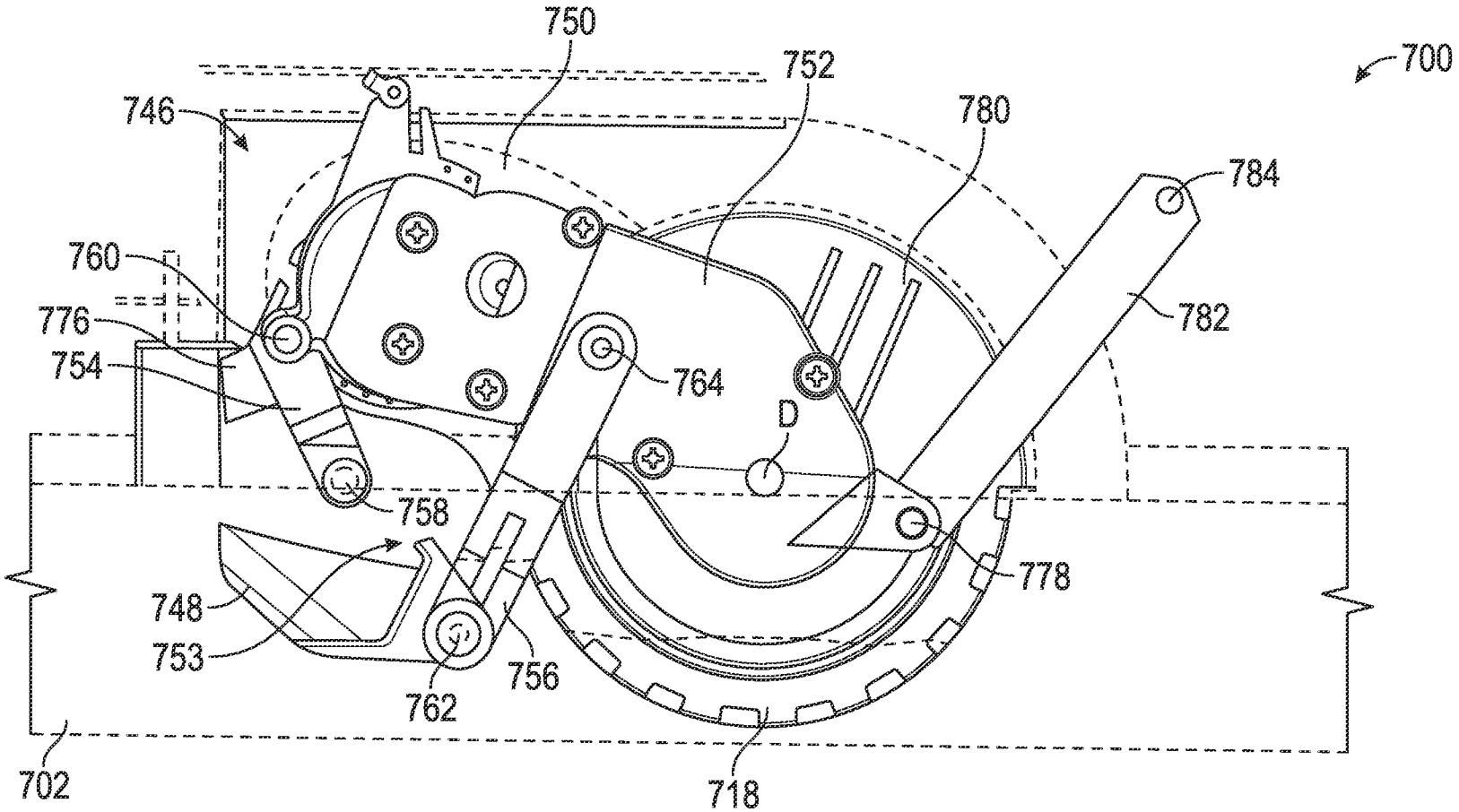
FIG. 7 illustrates a cross-section view of a portion of a mobile cleaning robot.
Figure 8:
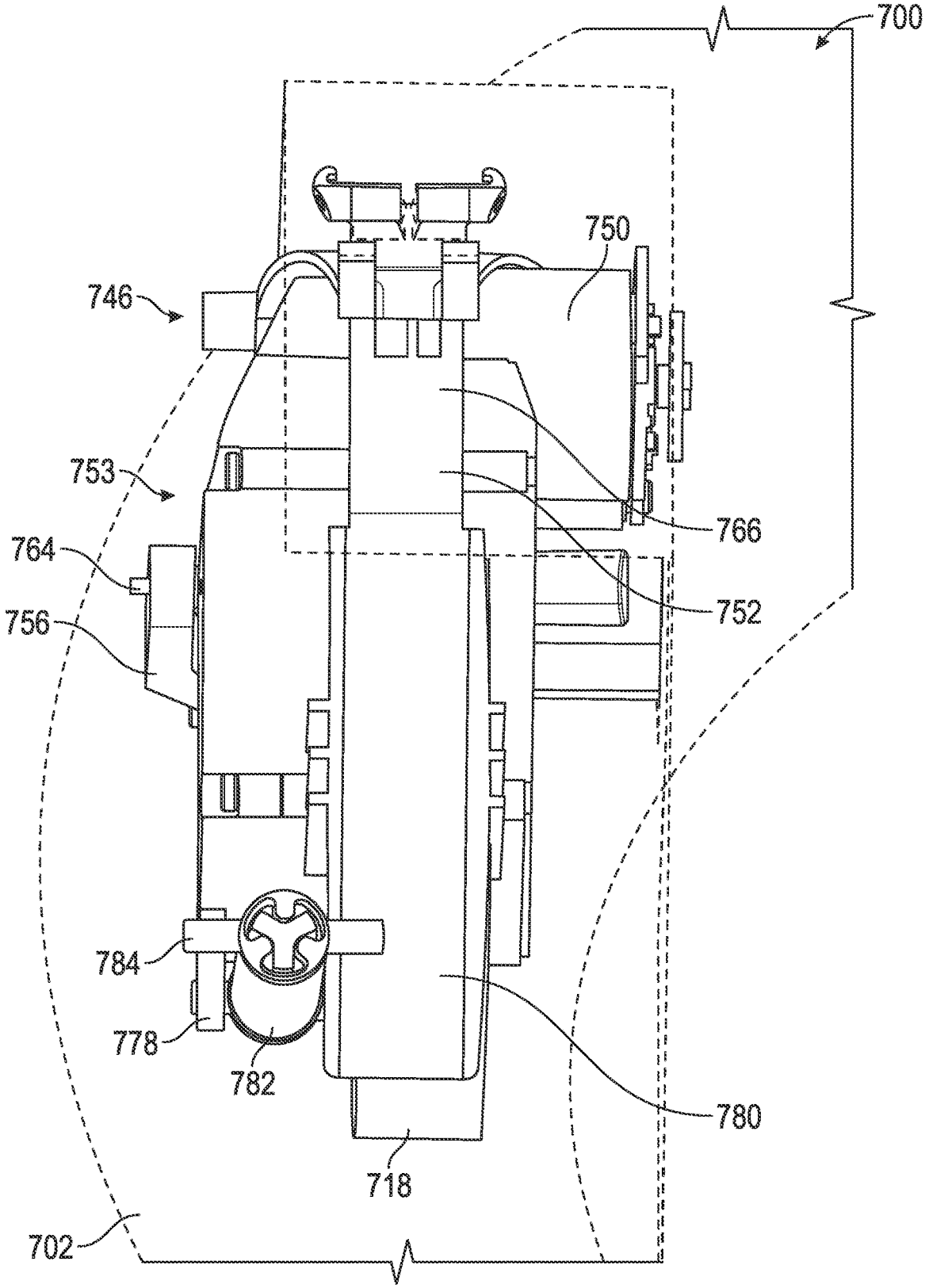
FIG. 8 illustrates a top view of a portion of a mobile cleaning robot.

FIG. 7 illustrates a cross-section view of a portion of a mobile cleaning robot 700. FIG. 8 illustrates a top view of a portion of the mobile cleaning robot 700. FIGS. 7 and 8 are discussed together below. The mobile cleaning robot 700 can be similar to the robots discussed above.

The mobile cleaning robot 700 can include a body 702 (e.g., similar to the body 102) configured to support one or more components of the mobile cleaning robot 700. The mobile cleaning robot 700 can also include a wheel module 746 including a drive wheel 718 (which can be similar to the drive wheels 118 or the drive wheel 418) such that the drive wheel 718 can move between an extended and retracted position and can be rotatable about a drive axis D to move the mobile cleaning robot 700 about an environment.

The mobile cleaning robot 700 can also include a mount 748 that can be connected to the body 702 or can be part of the body 702. A linkage assembly 753 can be connected to the mount 748 such as to pivotably connect the drive wheel 718 to the body 702. The wheel module 746 can also include a drive arm 752 connecting the mount 748 to the drive wheel 718 and connecting a motor 750 to the drive wheel 718 (e.g., via a gear train). The drive arm 752 can be connected to the mount 748 by the drive arm 752, which can include a first link 754 and a second link 756. The first link 754 can be pivotably coupled to the mount 748 by a pivot 758 and the first link 754 can be pivotably coupled to the drive arm 752 by a pivot 760. The second link 756 can be pivotably coupled to the mount 748 by a pivot 762 and the second link 756 can be pivotably coupled to the drive arm 752 by a pivot 764. The pivots can include bearings, bushings, or the like, configured to allow relative rotation of the links and the drive arm 752.

FIGS. 7 and 8 also show that the wheel module 746 can include a fender 780 that can at least partially surrounds the drive wheel 718 and that can be configured to protect the drive wheel 718 and can optionally engage the body 702 to limit movement of the drive wheel 718 between the extended position and the retracted position. The mobile cleaning robot 700 can also include a biasing element 782 connected to a biasing connector 778, where the biasing connector 778 can be connected to the drive arm 752. The biasing element 782, which can optionally be a spring piston assembly, can also be pivotably connected to the body 702 via a biasing pivot 784.

As shown in FIG. 7, the mobile cleaning robot 700 can include a stop 776 that can be connected to the first link 754 and can be engageable with the body 702 such as to limit movement of the drive wheel 718 past the retracted position. The stop 776 can also limit movement of the drive wheel 718 past the extended position. As shown in FIG. 8, the biasing element 782 can be in lateral alignment (or substantially in lateral alignment, such as offset by 1, 2, 3, 4, 5, millimeters, or the like) with the drive arm 752, which can help reduce a moment from being applied by the biasing element 782 to the drive arm 752 when downforce is applied by the biasing element 782 to the drive arm 752.

Also, as discussed in further detail below, the first link 754 and the second link 756 can be configured to locate a center of rotation of the linkage assembly 753 and the wheel module 746 that is in front of the drive wheel 718 and is located at or near a lower portion of the drive wheel 718 through a range of motion of the drive wheel 718 between an extended position and a retracted position.

Figure 9A:
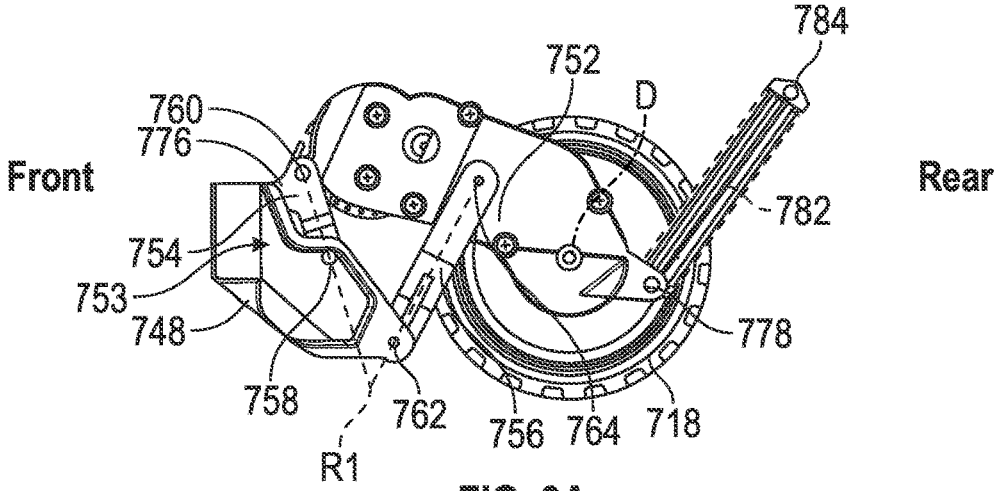
FIG. 9A illustrates a side view of a portion of a mobile cleaning robot in a first condition.
Figure 9B:
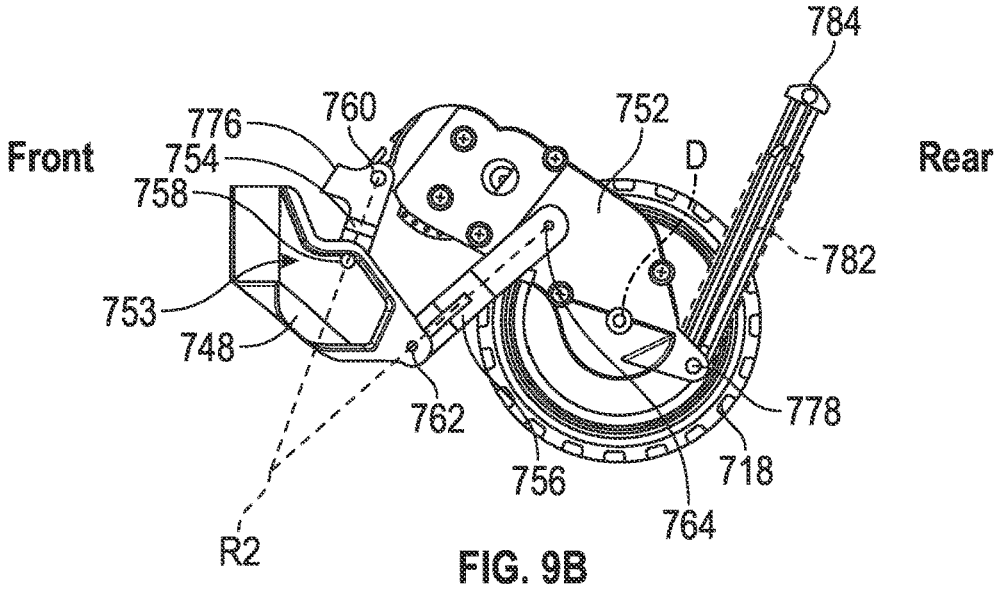
FIG. 9B illustrates a side view of a portion of a mobile cleaning robot in a second condition.
Figure 9C:
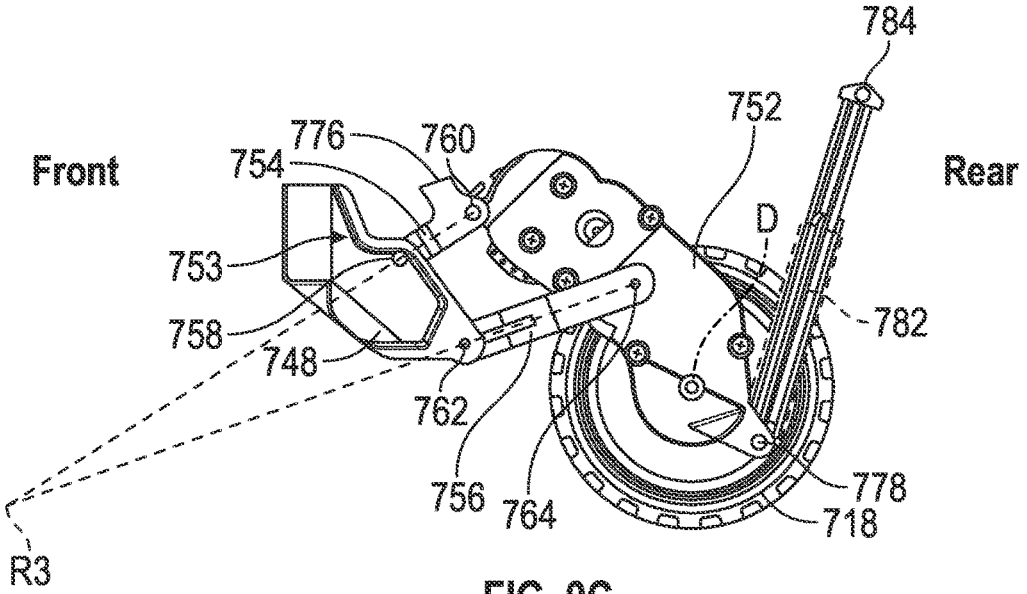
FIG. 9C illustrates a side view of a portion of a mobile cleaning robot in a third condition.

FIG. 9A illustrates a side view of a portion of the mobile cleaning robot 700 in a first condition. FIG. 9B illustrates a side view of a portion of the mobile cleaning robot 700 in a second condition. FIG. 9C illustrates a side view of a portion of the mobile cleaning robot 700 in a third condition. FIGS. 9A-9C are discussed together below. The mobile cleaning robot 700 of FIGS. 9A-9C can be consistent with the mobile cleaning robot 700 discussed above. FIGS. 9A-9B show how the linkage assembly 753 can allow a virtual center of rotation R (or virtual pivot or instantaneous center of rotation) to be moved as the drive wheel 718 moves between the retracted position and the extended position.

As shown in FIG. 9A, when the drive wheel 718 is in a retracted or near-retracted position, the location of the links drive arm 752 and first link 754 (represented by lines through their pivots 758, 760, 762, and 764), can define a virtual center R1 where the center of rotation R1 can be at or near a bottom portion of the drive wheel 718 which can be at or near the floor surface 50. In this position of extension of the drive wheel 718, the center of rotation R1 can also be below the drive axis D of the drive wheel 718, below the links 754 and 756, or below their pivots 758, 760, 762, and 764.

As the drive wheel 718 extends from the body 702, as shown in FIG. 9B, the center of rotation R2 can move downward such that the center of rotation R2 remains at or near a bottom portion of the drive wheel 718 which can be at or near the floor surface 50. In this position of extension of the drive wheel 718, the center of rotation R2 can also be below the drive axis D of the drive wheel 718, below the links 454 and 456, and below their pivots 758, 760, 762, and 764. And, As the drive wheel 718 extends from the body 702 further to a fully extended position (or near fully extended position) such that the body 702 is lifted off the floor surface 50, as shown in FIG. 9C, the center of rotation R3 can move further downward such that the center of rotation R2 remains at or near a bottom portion of the drive wheel 718 which can be at or near the floor surface 50. In this position of extension of the drive wheel 718, the center of rotation R3 can also be below the drive axis D of the drive wheel 718, below the links 754 and 756, or below their pivots 758, 760, 762, and 764.

By maintaining the center of rotation C at or near a bottom portion of the drive wheel 718 which can be at or near the floor surface 50 (and below most or all components of the mobile cleaning robot 700, a higher (or desired) downforce can be maintained throughout the range of travel of the drive wheel 718, helping to increase traction of the drive wheel(s) 718 and reduce drag on the mobile cleaning robot 700.

Notes And Examples

The following, non-limiting examples, detail certain aspects of the present subject matter to solve the challenges and provide the benefits discussed herein, among others.

Example 1 is a mobile cleaning robot movable within an environment, the mobile cleaning robot comprising: a body; a drive arm movable with respect to the body between an extended position and a retracted position; a drive wheel connected to the drive arm and movable therewith, the drive wheel operable to move the mobile cleaning robot; a first link connected to the body and connected to the drive arm; and a second link connected to the body and connected to the drive arm to, together with the first link, the body, and the drive arm, define a center of rotation about which the drive arm and the drive wheel rotate between the extended position and the retracted position.

In Example 2, the subject matter of Example 1 optionally includes wherein the first link and the second link are connected to the body and the drive arm to locate the center of rotation in front of the drive wheel when the drive wheel is between the extended position and the retracted position.

In Example 3, the subject matter of any one or more of Examples 1-2 optionally include wherein the first link and the second link are connected to the body and the drive arm to locate the center of rotation at or below a drive shaft axis when the drive wheel is between the extended position and the retracted position.

In Example 4, the subject matter of any one or more of Examples 1-3 optionally include a stop connected to the second link and engageable with the first link to limit rotation of the drive wheel and the drive arm past the retracted position, and engageable with the first link to limit rotation of the drive wheel and the drive arm past the extended position.

In Example 5, the subject matter of any one or more of Examples 1-4 optionally include a biasing member connected to the body and the drive arm to bias the drive arm toward the extended position.

In Example 6, the subject matter of Example 5 optionally includes wherein the biasing member includes a compression spring.

In Example 7, the subject matter of any one or more of Examples 5-6 optionally include wherein the drive arm is pivotably connected to the body, the first link is pivotably connected to the body and the drive arm, and the second link is pivotably connected to the body and the drive arm.

In Example 8, the subject matter of Example 7 optionally includes wherein the biasing member is pivotably connected to the drive arm and the body.

In Example 9, the subject matter of any one or more of Examples 1-8 optionally include a limit switch connected to the second link and engageable with the first link or the drive arm, the limit switch configured to generate a limit signal when the first link engages the limit switch and activates the limit switch.

In Example 10, the subject matter of Example 9 optionally includes wherein the drive arm includes a projection configured to engage the limit switch.

In Example 11, the subject matter of any one or more of Examples 1-10 optionally include a motor connected to the drive arm and movable with the drive arm, the motor including a drive shaft rotatable about a drive shaft axis that is perpendicular to a drive wheel axis of the drive wheel.

In Example 12, the subject matter of any one or more of Examples 1-11 optionally include wherein the first link has a first width and the second link has a second width that is smaller than the first width.

In Example 13, the subject matter of any one or more of Examples 1-12 optionally include wherein at least one of the first link and the second link connect to the body at a location below a drive wheel axis of the drive wheel when the drive wheel is in the retracted position.

Example 14 is a mobile cleaning robot movable within an environment, the mobile cleaning robot comprising: a body; a drive arm rotatable with respect to the body between an extended position and a retracted position; a drive wheel connected to the drive arm and movable therewith, the drive wheel rotatable about a drive axis to move the mobile cleaning robot; a first link pivotably connected to the body and pivotably connected to the drive arm; and a second link pivotably connected to the body and pivotably connected to the drive arm to, together with the first link, the body, and the drive arm, define a center of rotation about which the drive arm and the drive wheel rotate between the extended position and the retracted position, the center of rotation located in front of the drive wheel in each position of the drive wheel and the drive arm between the extended position and the retracted position.

In Example 15, the subject matter of Example 14 optionally includes wherein the first link and the second link are connected to the body and the drive arm to locate the center of rotation at or below a drive shaft axis when the drive wheel is between the extended position and the retracted position.

In Example 16, the subject matter of Example 15 optionally includes wherein at least one of the first link and the second link connect to the body at a location below a drive axis of the drive wheel when the drive wheel is in the retracted position.

In Example 17, the subject matter of any one or more of Examples 14-16 optionally include a motor connected to the drive arm and movable with the drive arm, the motor including a drive shaft rotatable about a drive shaft axis that is perpendicular to a drive wheel axis of the drive wheel.

In Example 18, the subject matter of any one or more of Examples 14-17 optionally include wherein the first link has a first width and the second link has a second width that is smaller than the first width.

In Example 19, the subject matter of any one or more of Examples 14-18 optionally include a limit switch connected to the second link and engageable with the first link or the drive arm, the limit switch configured to generate a limit signal when the first link engages the limit switch and activates the limit switch.

In Example 20, the subject matter of Example 19 optionally includes wherein the drive arm includes a projection configured to engage the limit switch.

In Example 21, the apparatuses or method of any one or any combination of Examples 1-20 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A mobile cleaning robot movable within an environment, the mobile cleaning robot comprising:

a body;

a drive arm movable with respect to the body between an extended position and a retracted position;

a drive wheel connected to the drive arm and movable therewith, the drive wheel operable to move the mobile cleaning robot;

a first link connected to the body and connected to the drive arm;

a second link connected to the body and connected to the drive arm to, together with the first link, the body, and the drive arm, define a center of rotation about which the drive arm and the drive wheel rotate between the extended position and the retracted position; and a stop connected to the second link and engageable with the first link to limit rotation of the drive wheel and the drive arm past the retracted position, and engageable with the first link to limit rotation of the drive wheel and the drive arm past the extended position.

2. The mobile cleaning robot of claim 1, wherein the first link and the second link are connected to the body and the drive arm to locate the center of rotation in front of the drive wheel when the drive wheel is between the extended position and the retracted position.

3. The mobile cleaning robot of claim 1, wherein the first link and the second link are connected to the body and the drive arm to locate the center of rotation at or below a drive shaft axis when the drive wheel is between the extended position and the retracted position.

4. The mobile cleaning robot of claim 1, further comprising:

a biasing member connected to the body and the drive arm to bias the drive arm toward the extended position.

5. The mobile cleaning robot of claim 4, wherein the biasing member includes a compression spring.

6. The mobile cleaning robot of claim 4, wherein the drive arm is pivotably connected to the body, the first link is pivotably connected to the body and the drive arm, and the second link is pivotably connected to the body and the drive arm.

7. The mobile cleaning robot of claim 6, wherein the biasing member is pivotably connected to the drive arm and the body.

8. The mobile cleaning robot of claim 1, further comprising:

a limit switch connected to the second link and engageable with the first link or the drive arm, the limit switch configured to generate a limit signal when the first link engages the limit switch and activates the limit switch.

9. The mobile cleaning robot of claim 8, wherein the drive arm includes a projection configured to engage the limit switch.

10. The mobile cleaning robot of claim 1, further comprising:

a motor connected to the drive arm and movable with the drive arm, the motor including a drive shaft rotatable about a drive shaft axis that is perpendicular to a drive wheel axis of the drive wheel.

11. The mobile cleaning robot of claim 1, wherein the first link has a first width and the second link has a second width that is smaller than the first width.

12. The mobile cleaning robot of claim 1, wherein at least one of the first link and the second link connect to the body at a location below a drive wheel axis of the drive wheel when the drive wheel is in the retracted position.

13. A mobile cleaning robot movable within an environment, the mobile cleaning robot comprising:

a body;

a drive arm rotatable with respect to the body between an extended position and a retracted position;

a drive wheel connected to the drive arm and movable therewith, the drive wheel rotatable about a drive axis to move the mobile cleaning robot;

a first link pivotably connected to the body and pivotably connected to the drive arm;

a second link pivotably connected to the body and pivotably connected to the drive arm to, together with the first link, the body, and the drive arm, define a center of rotation about which the drive arm and the drive wheel rotate between the extended position and the retracted position, the center of rotation located in front of the drive wheel in each position of the drive wheel and the drive arm between the extended position and the retracted position; and a motor connected to the drive arm and movable with the drive arm, the motor including a drive shaft rotatable about a drive shaft axis that is perpendicular to a drive wheel axis of the drive wheel.

14. The mobile cleaning robot of claim 13, wherein the first link and the second link are connected to the body and the drive arm to locate the center of rotation at or below a drive shaft axis when the drive wheel is between the extended position and the retracted position.

15. The mobile cleaning robot of claim 14, wherein at least one of the first link and the second link connect to the body at a location below a drive axis of the drive wheel when the drive wheel is in the retracted position.

16. The mobile cleaning robot of claim 13, wherein the first link has a first width and the second link has a second width that is smaller than the first width.

17. The mobile cleaning robot of claim 13, further comprising:

a limit switch connected to the second link and engageable with the first link or the drive arm, the limit switch configured to generate a limit signal when the first link engages the limit switch and activates the limit switch.

18. The mobile cleaning robot of claim 17, wherein the drive arm includes a projection configured to engage the limit switch.

19. A mobile cleaning robot movable within an environment, the mobile cleaning robot comprising:

a body;

a drive arm movable with respect to the body between an extended position and a retracted position;

a drive wheel connected to the drive arm and movable therewith, the drive wheel operable to move the mobile cleaning robot;

a first link connected to the body and connected to the drive arm;

a second link connected to the body and connected to the drive arm to, together with the first link, the body, and the drive arm, define a center of rotation about which the drive arm and the drive wheel rotate between the extended position and the retracted position; and a limit switch connected to the second link and engageable with the first link or the drive arm, the limit switch configured to generate a limit signal when the first link engages the limit switch and activates the limit switch.

20. The mobile cleaning robot of claim 19, wherein the drive arm includes a projection configured to engage the limit switch.

* * * * *